US012029312B2

(12) United States Patent
Calloway et al.

(10) Patent No.: US 12,029,312 B2
(45) Date of Patent: Jul. 9, 2024

(54) GUTTER BROOM

(71) Applicant: Old Dominion Brush Company, Henrico, VA (US)

(72) Inventors: Britt R. Calloway, Midlothian, VA (US); Josh Coker, New Kent, VA (US); Robert Mayes, Hanover, VA (US); Tim Stumph, Midlothian, VA (US); Chris Turner, Aylett, VA (US)

(73) Assignee: Old Dominion Brush Company, Henrico, VA (US)

( * ) Notice: Subject to any disclaimer, the term of this patent is extended or adjusted under 35 U.S.C. 154(b) by 0 days.

(21) Appl. No.: 18/330,977

(22) Filed: Jun. 7, 2023

(65) Prior Publication Data

US 2023/0309683 A1 Oct. 5, 2023

Related U.S. Application Data

(63) Continuation of application No. 18/064,041, filed on Dec. 9, 2022, now Pat. No. 11,759,004, which is a (Continued)

(51) Int. Cl.

| | |
|---|---|
| ***A46B 7/04*** | (2006.01) |
| ***A46B 3/16*** | (2006.01) |
| ***A46B 9/02*** | (2006.01) |
| ***A46B 13/00*** | (2006.01) |

(Continued)

(52) U.S. Cl.

CPC ..... *A46B 7/042* (2013.01); *A46B 3/16* (2013.01); *A46B 9/02* (2013.01); *A46B 13/008* (2013.01);

(Continued)

(58) Field of Classification Search

CPC ..... A46B 7/04; A46B 7/042; A46B 7/044; A46B 7/048; A46B 3/19; A46B 9/02; A46B 13/008

See application file for complete search history.

(56) References Cited

U.S. PATENT DOCUMENTS

| | | | |
|---|---|---|---|
| 2,565,047 | A | 8/1951 | Rowland |
| 2,923,958 | A | 2/1960 | Lechene |

(Continued)

FOREIGN PATENT DOCUMENTS

| | | | |
|---|---|---|---|
| CH | 647836 | A5 * | 2/1985 |
| CH | 647836 | A5 | 2/1985 |

(Continued)

OTHER PUBLICATIONS

International Search Report and Written Opinion of the International Searching Authority issued on International Application No. PCT/US2021/060121, dated Mar. 22, 2022, 13 pages.

*Primary Examiner* — Shay Karls
(74) *Attorney, Agent, or Firm* — Sterne, Kessler, Goldstein & Fox P.L.L.C.

(57) ABSTRACT

A gutter broom is provided. The gutter broom can include a mandrel, one or more carriers, each carrier removably coupled to the mandrel, and one or more bristle strips, each bristle strip removably coupled to one of the carriers. The gutter broom components can be recyclable and modular, requiring no tools for assembly or servicing.

19 Claims, 23 Drawing Sheets

Related U.S. Application Data continuation of application No. 17/531,001, filed on Nov. 19, 2021, now Pat. No. 11,523,676.

(60) Provisional application No. 63/116,263, filed on Nov. 20, 2020.

(51) Int. Cl.
*A46D 1/00* (2006.01)
*E01H 1/05* (2006.01)

(52) U.S. Cl.
CPC ..... *A46D 1/0207* (2013.01); *E01H 1/053* (2013.01); *A46B 2200/3066* (2013.01)

(56) References Cited

U.S. PATENT DOCUMENTS

| | | | |
|---|---|---|---|
| 3,243,832 | A | 4/1966 | Allen et al. |
| 4,409,702 | A | 10/1983 | Brown |
| 5,045,091 | A | 9/1991 | Abrahamson et al. |
| 5,438,728 | A | 8/1995 | Kubes et al. |
| 5,445,438 | A | 8/1995 | Drumm |
| 6,026,533 | A | 2/2000 | Prohoroff |
| 7,203,987 | B2 | 4/2007 | Kuivikko et al. |
| 9,415,482 | B2 | 8/2016 | Jespersen |

FOREIGN PATENT DOCUMENTS

| | | | | | |
|---|---|---|---|---|---|
| CN | 2858763 | Y | | 1/2007 | |
| DE | 3711181 | C2 | | 10/1988 | |
| EP | 1419713 | A1 | | 5/2004 | |
| EP | 1623652 | A1 | | 8/2006 | |
| ES | 2395270 | B1 | | 12/2013 | |
| FR | 2614188 | A1 | | 10/1988 | |
| GB | 2465381 | A | * | 5/2010 | ..... A46B 13/006 |
| JP | 2009-108632 | A | | 5/2009 | |
| JP | 2009131386 | A | * | 6/2009 | |
| WO | 2016043152 | A1 | | 3/2016 | |

* cited by examiner

GUTTER BROOM

CROSS-REFERENCE TO RELATED APPLICATIONS

The present application is a continuation of U.S. application Ser. No. 18/064,051, filed Dec. 9, 2022, which is a continuation of U.S. application Ser. No. 17/531,001, filed Nov. 19, 2021, which claims benefit of and priority to U.S. Provisional Patent App. No. 63/116,263, filed Nov. 20, 2020, both of which are incorporated herein by reference in their entirety.

FIELD

The present disclosure relates to sweepers for cleaning surfaces. In particular, gutter brooms for cleaning roads, streets, and other surfaces.

BACKGROUND

Sweepers can be used to remove debris and particulate matter from various surfaces. In particular, a gutter broom can be used to clean roads, streets, and other surfaces and can be mounted onto a surface cleaning vehicle to move across the surface. The gutter broom can also approach a curb or a side of a building to remove debris. The gutter broom can include a brush mount that receives brush bristles for sweeping.

BRIEF SUMMARY

One aspect provides a gutter broom that can include a mandrel, a retaining carrier, and a bristle strip. The mandrel can include a channel that extends outwardly from an inner radial edge at an angle relative to a centerline of the mandrel. The retaining carrier can be positioned in the channel and coupled to the mandrel. The bristle strip can be coupled to the carrier such that it is retained, and can extend downward from the carrier. In an aspect, the bristle strip can include a cable and bristles folded around the cable. In a further aspect, the cable can be positioned within a cavity of the carrier to couple the bristle strip to the carrier. In another aspect, the bristle strip can include an upper end having a first cross-sectional area and a lower end having a second cross-sectional area, the first cross-sectional area can be greater than the second cross-sectional area. In a further aspect, the bristle strip can be coupled to the carrier at the upper end. In another aspect, the carrier can be oriented obliquely with respect to the channel. In an aspect, the carrier can include a lock to retain the bristle strip. In a further aspect, the lock can include a cantilevered portion. In a further aspect, the lock can extend across one or more sides of the carrier. In a further aspect, the lock can prevent radial outward movement of the bristle strip coupled to the carrier. In an aspect, the angle can be 30 degrees.

Another aspect provides a retaining carrier coupled to a mandrel. The mandrel can include a cavity to receive a bristle strip and a lock to prevent radial outward movement of the bristle strip. In an aspect, the carrier can include an upper end that extends upward from the mandrel, and a lower end that extends downward from the mandrel. In a further aspect, the bristle strip can include an end having a larger cross-sectional area to be removably positioned in the upper end of the carrier. In a further aspect, the lock can extend across the upper end of the carrier to prevent radial outward movement of the bristle strip. In another aspect, the carrier can include an open end. The carrier can be positioned in a channel that can extend from the mandrel, and the open end can be remote from a central opening of the mandrel. In a further aspect, the lock can extend across the open end of the carrier to prevent radial outward movement of the bristle strip positioned within the cavity of the carrier.

Another aspect provides a method for replacing the broom bristle strips without using tools. The method can include providing a gutter broom. The gutter broom can include a mandrel, a carrier coupled to the mandrel, and the bristle strip, the bristle strip positioned in the carrier. The method can also include opening a lock at an open end of the carrier; removing the bristle strip from the carrier; inserting a second bristle strip into the carrier; and closing the lock such that it retains the bristle strip in the carrier. In an aspect, the method can include latching the lock to the carrier, and releasing the lock from the carrier. In an aspect, the method can include retaining the gutter broom on a drive plate. The mandrel can be coupled to the drive plate. In another aspect, the method can include pivoting the carrier inward, and sliding the carrier out of the gutter broom. In a further aspect, the method can include pivoting a second carrier inward, and sliding the second carrier into the gutter broom.

Another aspect provides a bristle strip to couple to a retaining carrier. The bristle strip can include one or more bristles folded over a cable, an upper end having a first cross-sectional area, and a lower end having a second cross-sectional area smaller than the first cross-sectional area. The lower end can be oriented obliquely relative to the upper end to form an obtuse angle. In an aspect, the one or more bristles can include steep. In another aspect, the one or more bristles can be encased in a steel insert. In an aspect, the carrier can include a lock that extends across an open end of the carrier to radially retain the bristle strip. In an aspect, the upper end can be positioned in an upper cavity of the carrier. The lower end can be positioned in a lower cavity of the carrier. In a further aspect, the upper cavity can be oriented obliquely relative to the lower cavity to form an obtuse angle such that the bristle strip is retained laterally.

BRIEF DESCRIPTION OF THE DRAWINGS/FIGURES

The accompanying drawings, which are incorporated herein and form part of the specification, illustrate embodiments and, together with the description, further serve to explain the principles of the embodiments and to enable a person skilled in the relevant art(s) to make and use the embodiments.

Figure 12:
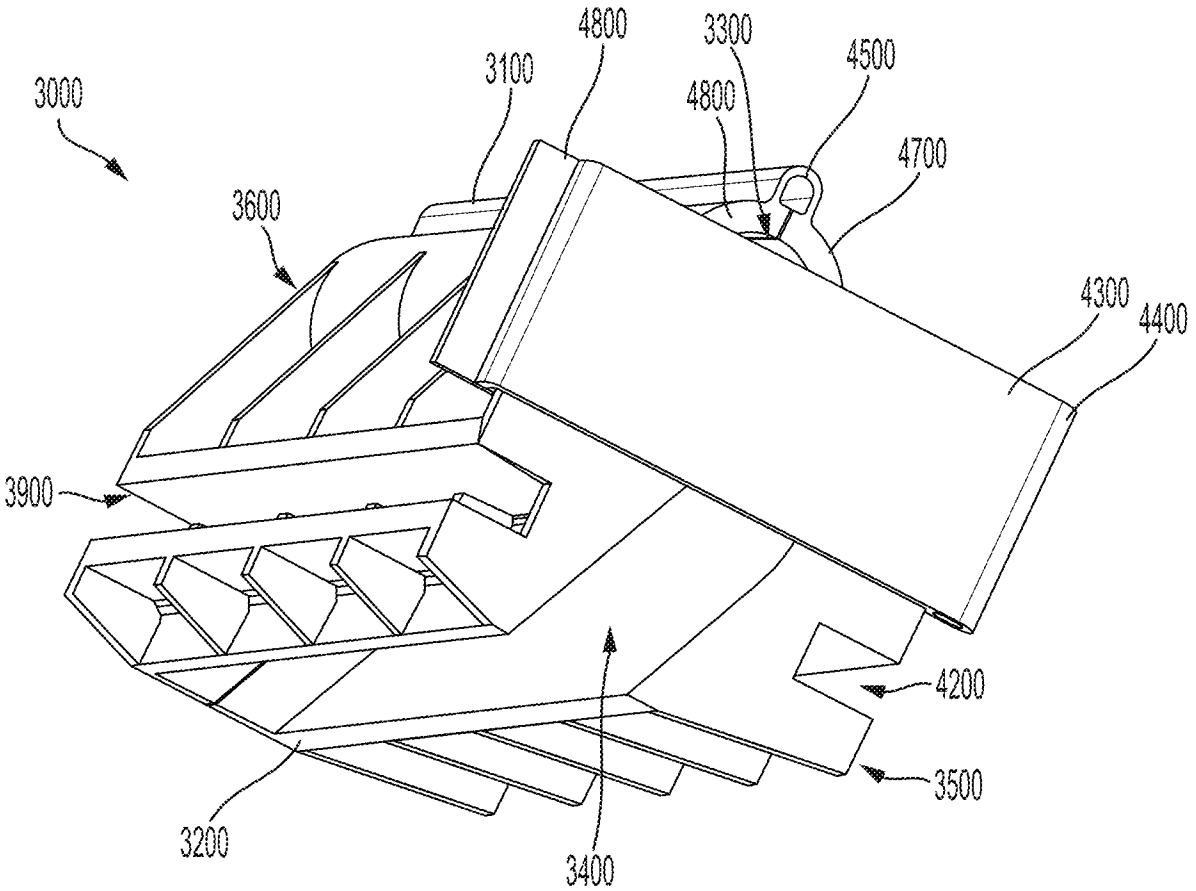
FIG. 12 is a perspective view of a carrier according to various aspects.
Figure 15B:
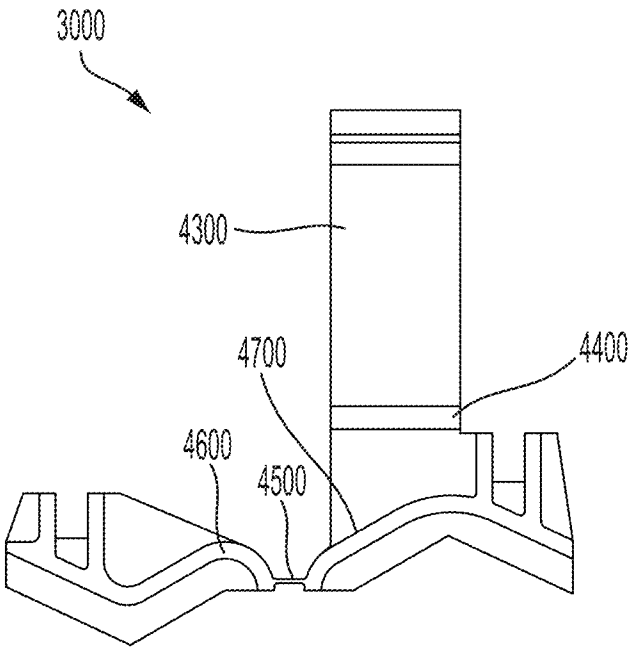
Figure 15A:
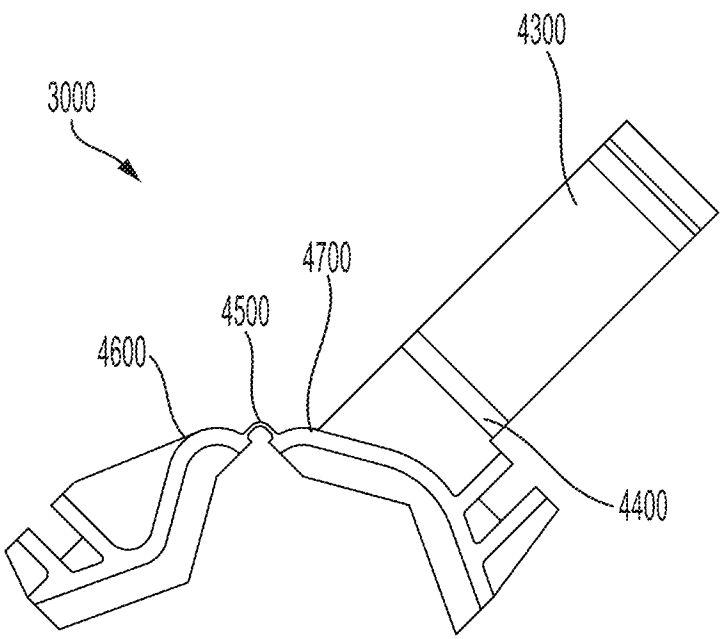

FIGS. 15A-B are front views of the carrier of FIG. 12.

Figure 16:
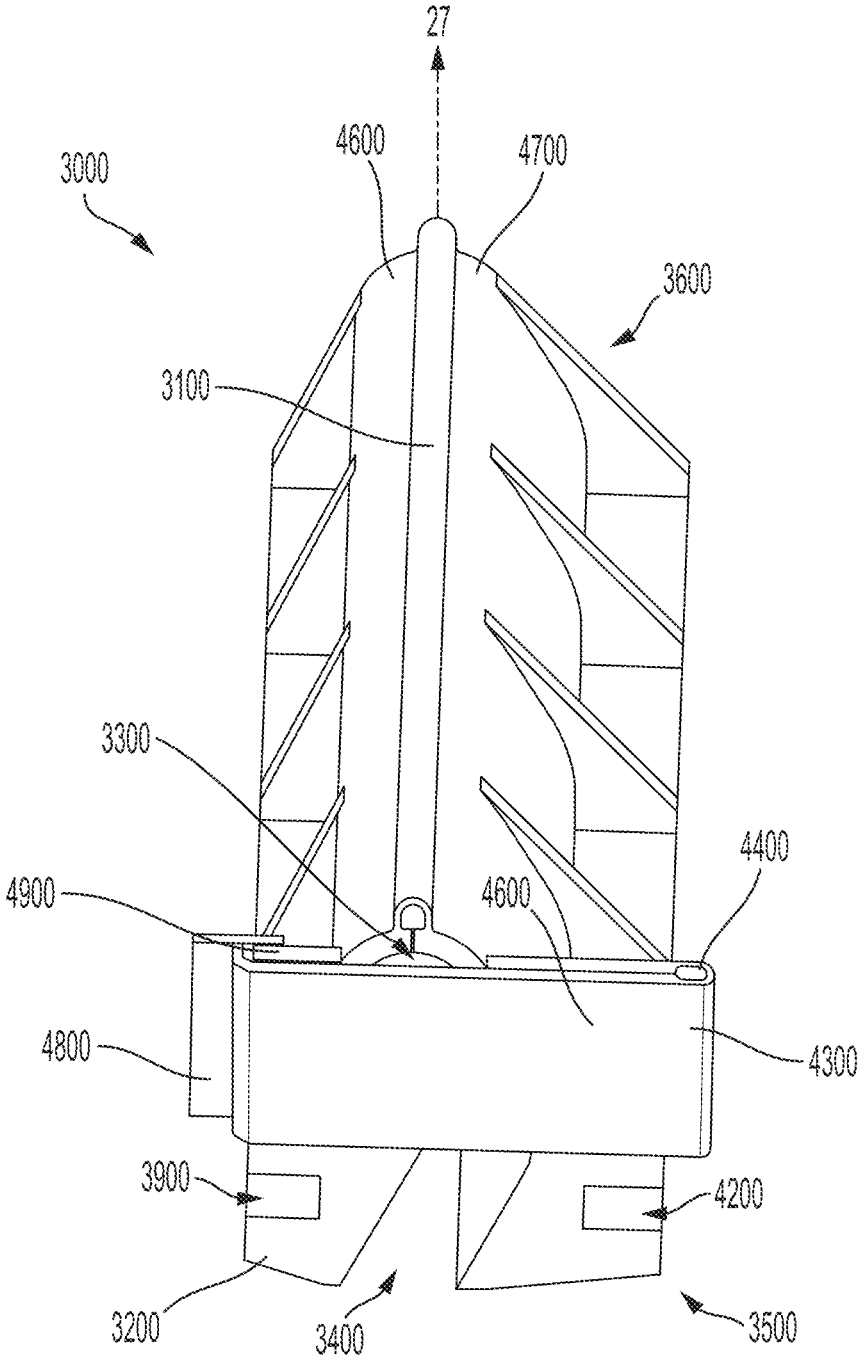

FIG. 16 is a perspective view of the carrier of FIG. 12.

Figure 17:
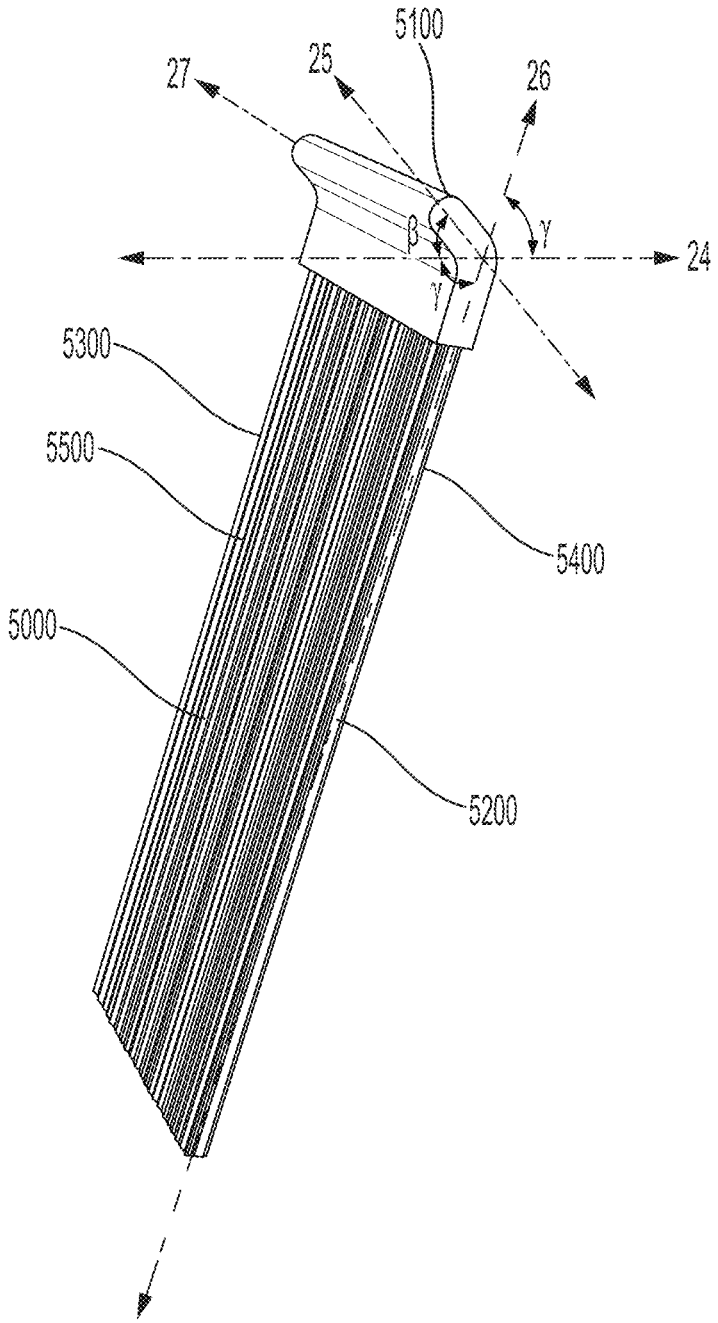

FIG. 17 is a perspective view of a bristle strip according to various aspects.

Figure 18:
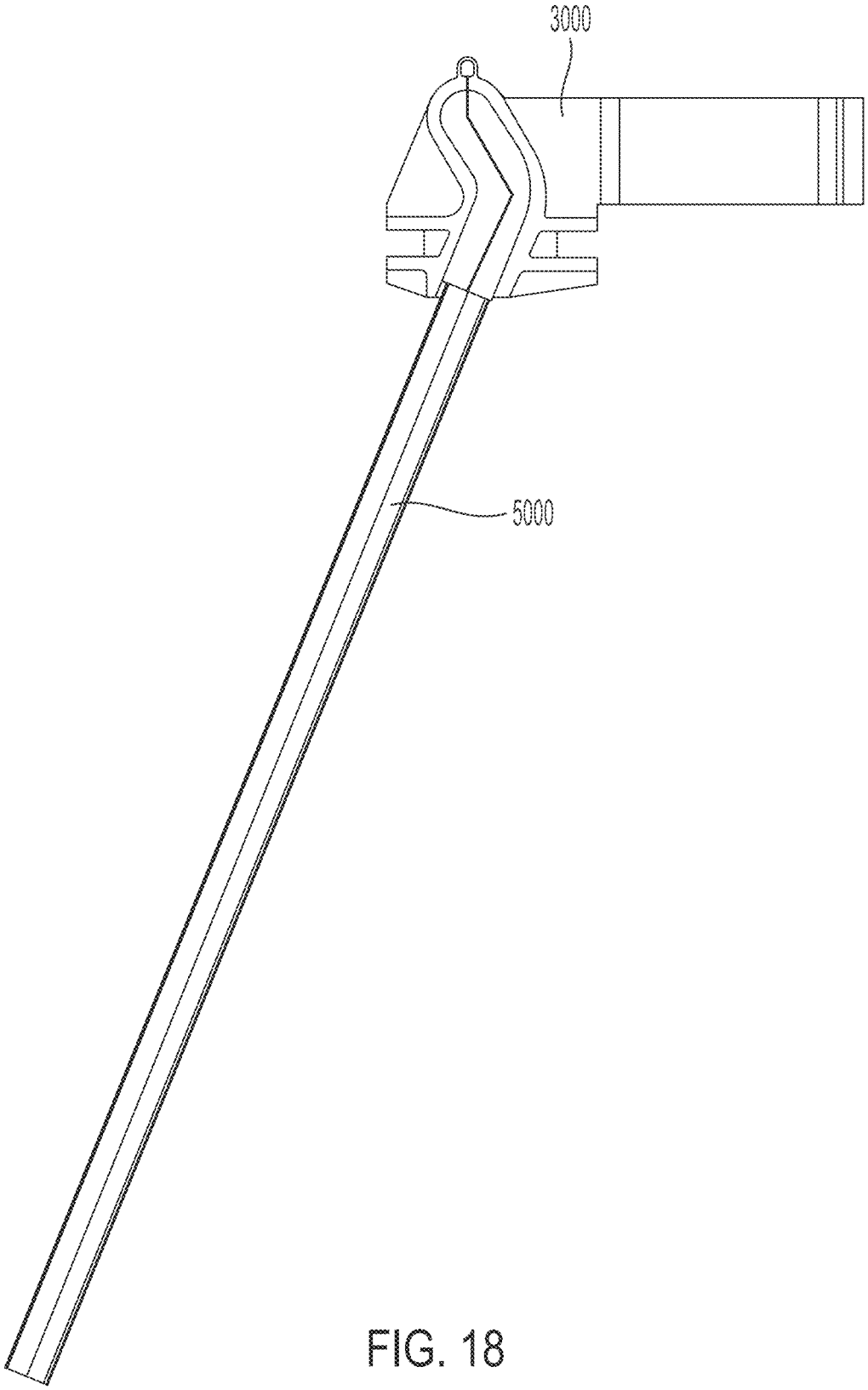

FIG. 18 is a side view of a carrier and bristle strip according to various aspects.

Figure 19:
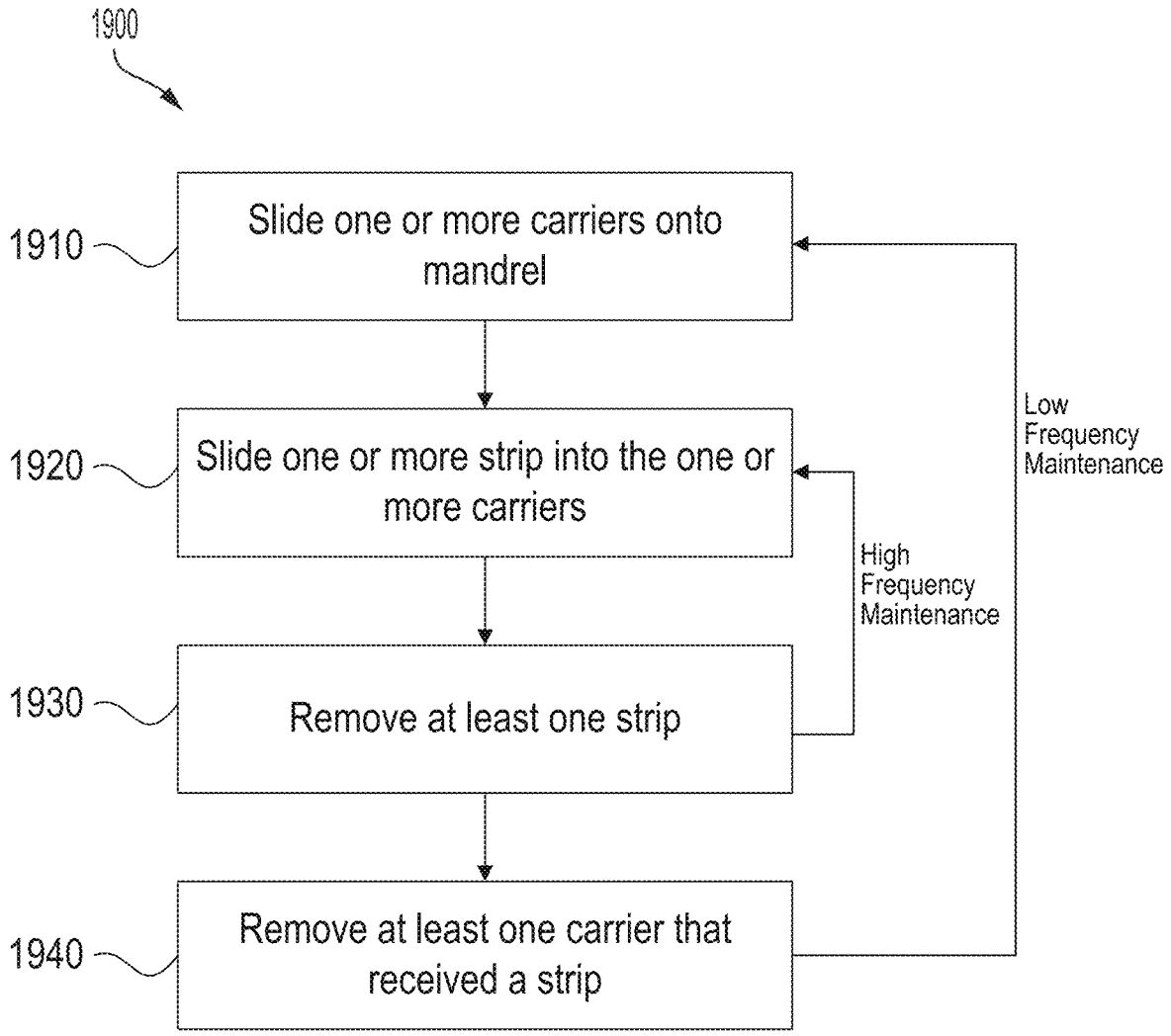

FIG. 19 is an example method according to various aspects.

Figure 1A:
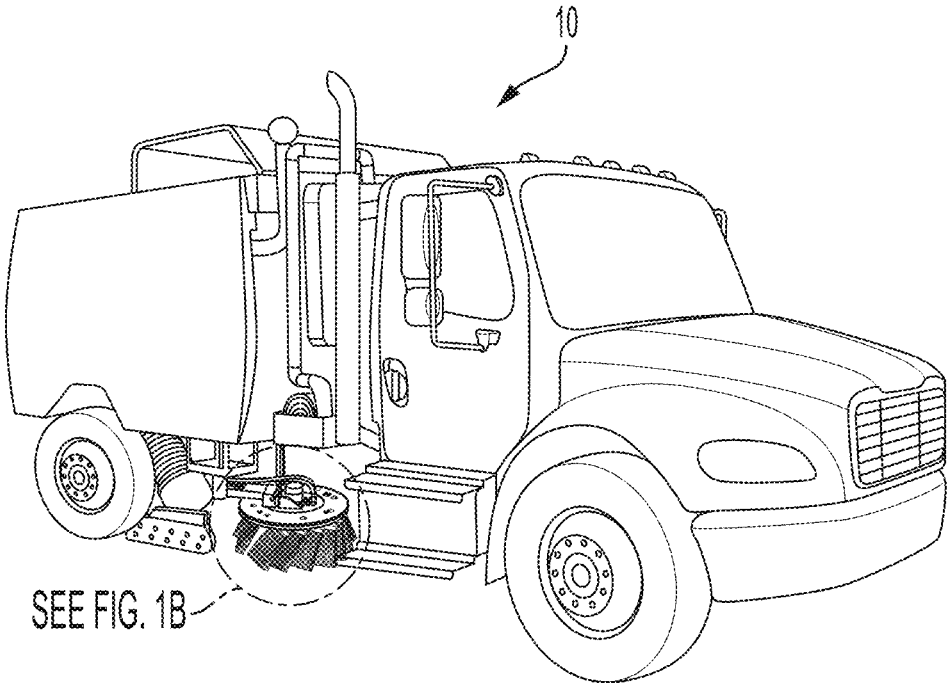
FIG. 1A is a perspective view of a vehicle with a gutter broom according to various aspects.
Figure 20:
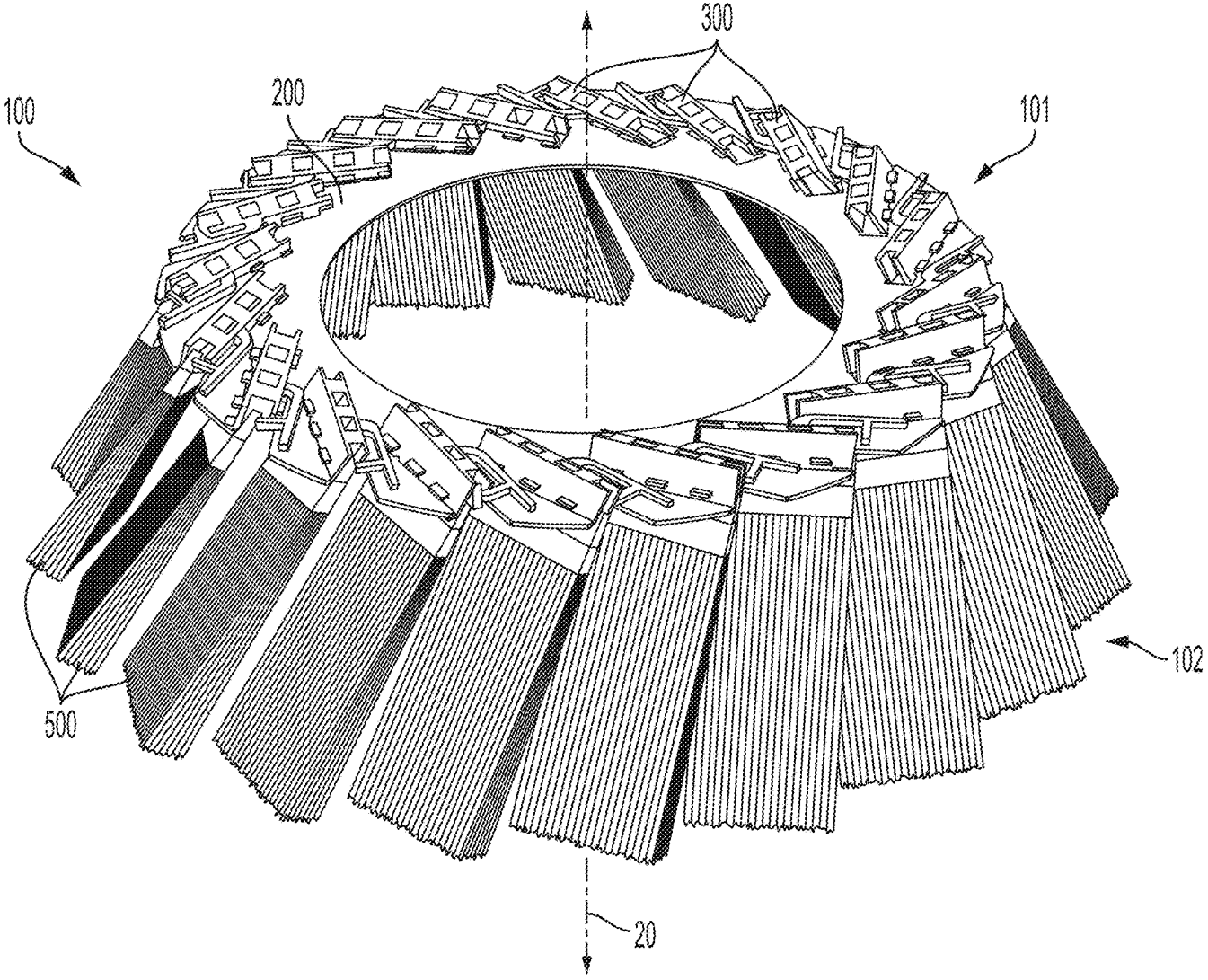

FIG. 20 is a perspective view of the gutter broom of FIG. 1A.

Figure 21:
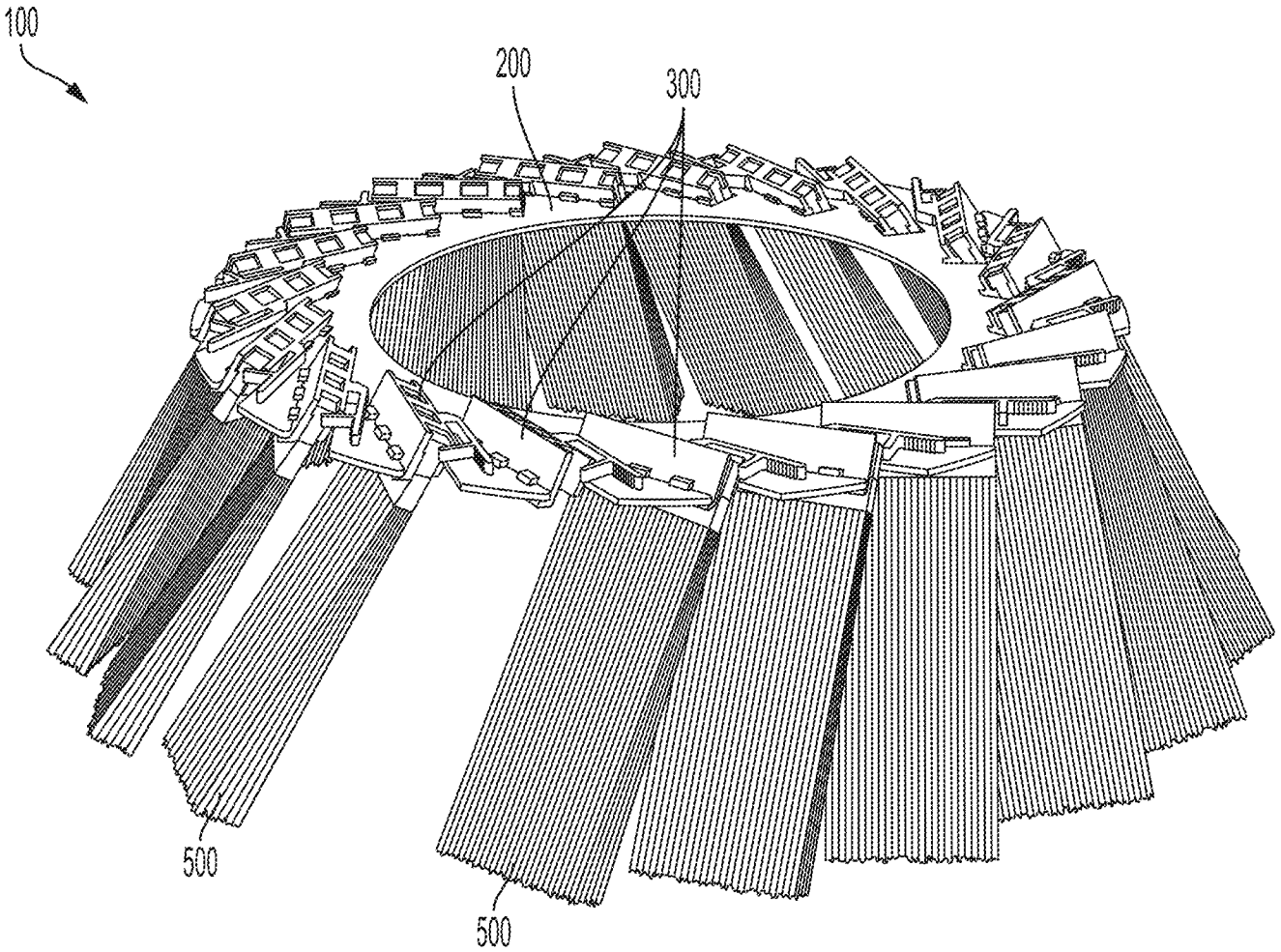

FIG. 21 is a perspective view of the gutter broom of FIG. 1A.

Figure 22:
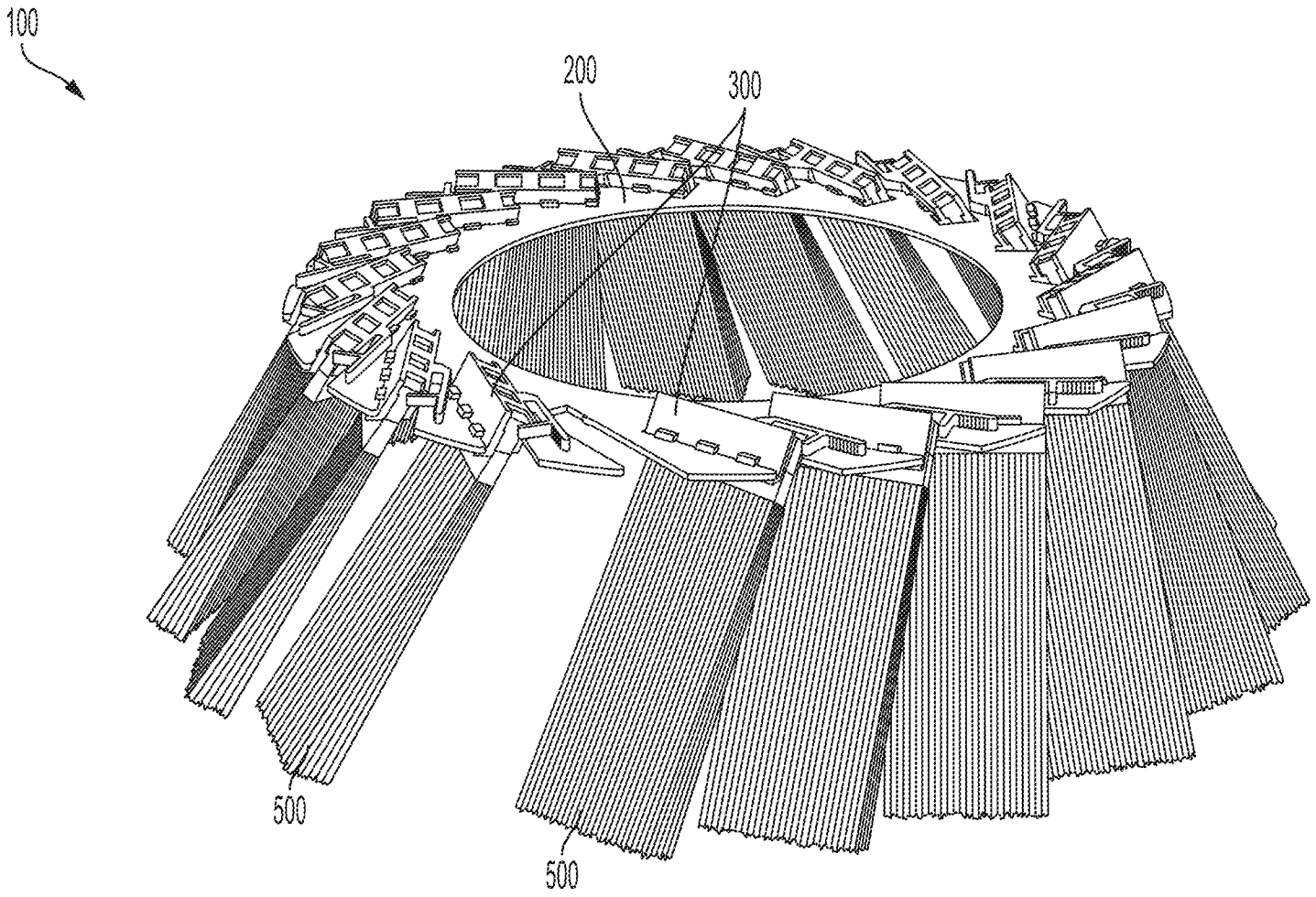

FIG. 22 is a perspective view of the gutter broom of FIG. 1A.

Figure 23:
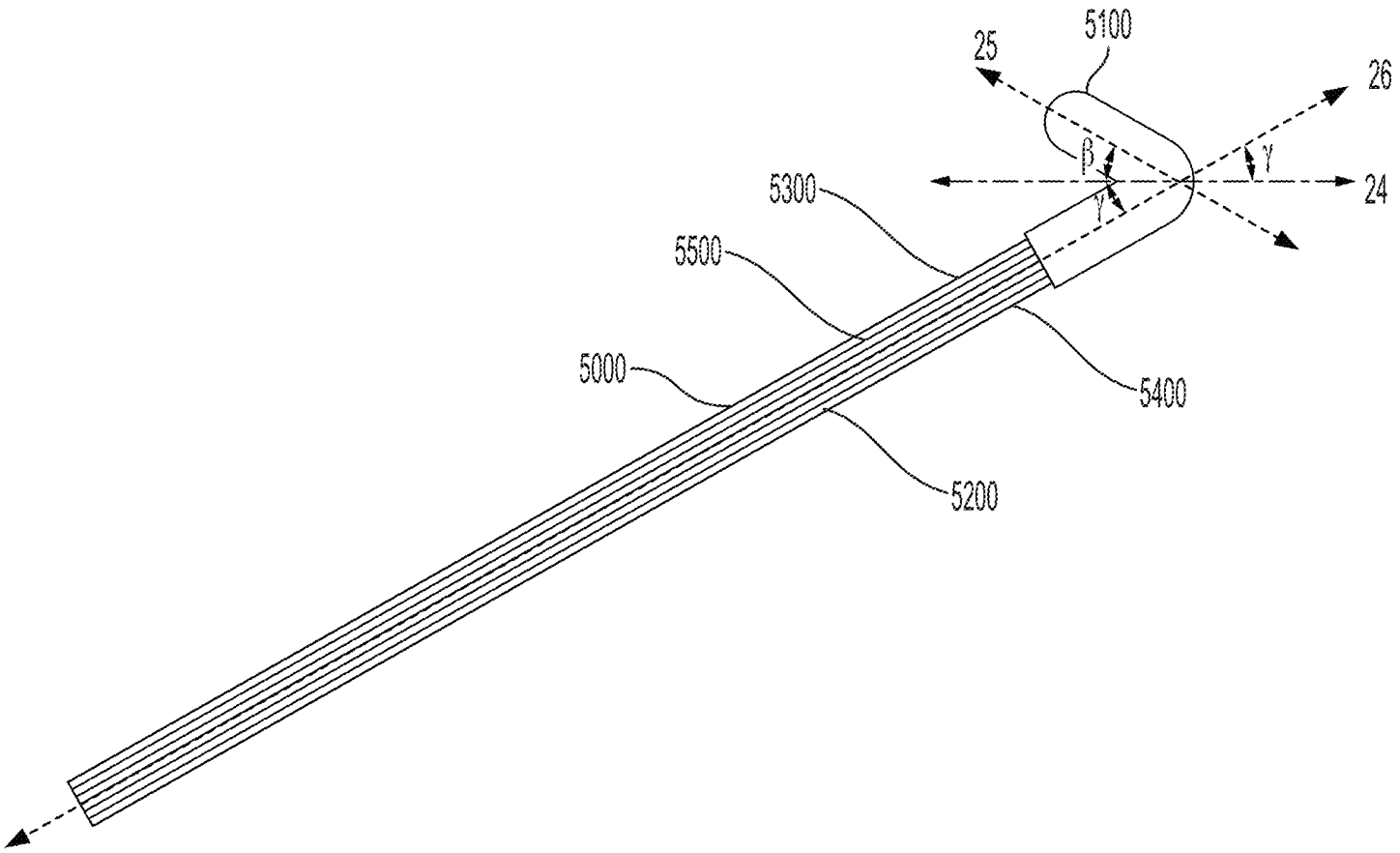

FIG. 23 is a perspective view of a bristle strip according to various aspects.

The features and advantages of the aspects will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION

The present invention(s) will now be described in detail with reference to aspects thereof as illustrated in the accompanying drawings. References to "one aspect," "an aspect," "an exemplary aspect," etc., indicate that the aspect described may include a particular feature, structure, or characteristic, but every aspect may not necessarily include the particular feature, structure, or characteristic. Moreover, such phrases are not necessarily referring to the same aspect. Further, when a particular feature, structure, or characteristic is described in connection with an aspect, it is submitted that it is within the knowledge of one skilled in the art to affect such feature, structure, or characteristic in connection with other aspects whether or not explicitly described.

The following examples are illustrative, but not limiting, of the present aspects. Other suitable modifications and adaptations of the variety of conditions and parameters normally encountered in the field, and which would be apparent to those skilled in the art, are within the spirit and scope of the disclosure.

Aspects of the present disclosure discuss a gutter broom. The gutter broom can rotate around its central axis (i.e., its axis of rotation) to clean a surface along its path. The gutter broom, as described herein, can include a mandrel (i.e., a driven plate), one or more carriers, and one or more bristle strips (i.e., strips, broom segments, broom attachments, brush, bristles, etc.). The mandrel can be positioned approximately parallel to a horizontal direction and can rotate about a vertical axis. The mandrel can be circular or arced and can support approximately 20 bristle strips and carriers that extend downward from the mandrel. Each carrier can be removably coupled to the mandrel in a channel extending through a radial outer end of the mandrel. For example, the channel can extend outwardly from a radial inner edge. The channel can extend at an angle relative to a centerline of the mandrel. Detent tabs along the outer end of the mandrel can secure the carriers in the radial direction. Tabs along each side of the carriers can secure the carriers to the mandrel in the lateral direction. Each bristle strip can similarly be removably coupled to the mandrel and secured in both the radial and the lateral directions. Aspects provide that bristle strips can be inserted into the carriers and can be secured in the lateral and/or radial direction by, for example, a press fit, snap fit, interference fit, adhesive, a lock, or another attachment method.

Roadway surfaces can be made of different materials (e.g., concrete, cobblestone, brick, etc.) and/or amass debris (e.g., growth, mud, non-natural debris, etc.), thus requiring cleaning applications that vary in contact pressure, time, or other parameters. In the gutter broom, bristle strips can extend down from the carriers to contact surfaces for cleaning. Aspects provide bristle strips that can be made of steel and/or another material (e.g., metals, plastics, composites, natural materials, etc.), and that can vary in dimensions, stiffness, geometry, or other properties for cleaning a variety of surfaces. For example, bristle strips can be composed of steel (e.g., steel wire). Steel can be sufficiently rigid to break down and/or move debris. Aspects provide that bristle strips can be composed of 100% recyclable steel. Accordingly, the gutter broom having recyclable steel bristle strips can be environmentally conscious. Other aspects provide that bristle strips can be composed of other materials, or a blend of materials. For example, a bristle strip can have a steel and polypropylene mix. In some aspects, the mandrel can also be composed of 100% recyclable steel. The carriers can be injection molded plastic in some aspects.

The gutter broom described herein can be modular. For example, the arrangement of the mandrel, carriers, and bristle strips can be modified both at initial assembly and during the life and operation of the gutter broom. Operators can customize the gutter broom to target the specific needs of a surface, e.g., by varying the number of bristle strips having specific characteristics. For example, a gutter broom can include a first type of bristle strips that provide fine contact and a second type of bristle strips that provide more aggressive contact. This can help to target surfaces having tough debris, such as growth, while also limiting the overall abrasive contact of the gutter broom so that roadway surfaces are not damaged. Modularity can also streamline assembly of the gutter broom and later replacement of the bristles. Instead of delivering a gutter broom that is at least partially assembled, which can increase packaging and delivery costs, modular components can be delivered compactly in fewer and smaller bundles (e.g., flat-packed or densely packed into two boxes).

The modular components can be individually manufactured to support custom servicing. For example, if an operator requires a replacement carrier or bristle strip, they can source components instead of obtaining an entirely new gutter broom to acquire new parts. In some aspects, the gutter broom can cycle through many component replacements in its lifetime. Components can be individually sourced to replace damaged or worn components. Similarly, components can be exchanged between gutter brooms to support customization and servicing. In an aspect, modularity can also support the cleaning of each component to prevent contamination by, for example, mud or sand.

Bristle strips can be arranged on the gutter broom in the carriers at an angle. In this way, each adjacent bristle strip can be offset. The angled arrangement of the bristle strips on the gutter broom can support distributed contact with a surface such that each bristle strip wears evenly as compared to other bristle strips assembled at the same time and having the same properties. A mandrel having a larger interior can also support this aspect. Because of the distributed wear, the bristle strips assembled at the same time and having the same properties can be replaced together. According to aspects, each bristle strip can last for approximately 80 to approximately 150 hours without needing servicing or replacement of the bristle strips.

Servicing can also be simple such that no tools are required. For example, bristle strips can be positioned into carriers and easily removed in the same way, mechanically and without using tools. Accordingly, fewer and/or less skilled operators can assemble and service the gutter broom and replace worn bristle strips. Furthermore, assembly and replacement of bristle strips can occur in reduced time, e.g., minutes compared to hours. In some aspects, while the gutter broom is mounted onto a vehicle, a lock on each carrier can be opened, for example by pivoting the lock away from its locked position. This can allow radial movement of the bristle strips positioned in the carriers such that they can slide out of the carrier for replacement or servicing. Because the locks are simply pivoted away from their locked position to replace bristle strips, the gutter broom can remain mounted onto the vehicle during replacement. In this way, operators can easily complete replacement on the side of the road or a stopping area.

The gutter broom described herein can additionally be efficiently manufactured because each component can be discretely produced and distributed. Further, including bristle strips of varying properties (e.g., stiffness) can reduce the weight of the gutter broom, which can support manufacturing efficiency. Increased manufacturing efficiency can significantly reduce the cost of the gutter broom. Cost savings can additionally progress beyond manufacturing, e.g., the lower weight of the gutter broom can support extended motor life and limited operating costs. Accordingly, bristle strip selection can be a function of surface type to both effectively clean and prevent damage from continuous abrasive contact, along with operating device motor considerations.

Figure 1B:
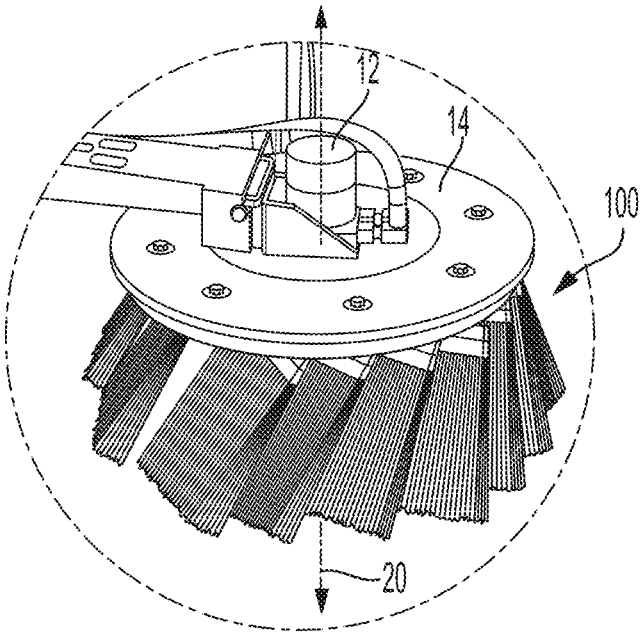
FIG. 1B is an enlarged view of the gutter broom of FIG. 1A.

A gutter broom 100 is shown in FIGS. 1A-B. While gutter broom 100 is described herein, it is to be appreciated that its components can be used in other gutter brooms or gutter broom systems, e.g., for retrofit, customization by exchange of components, etc.

In some aspects, gutter broom 100 can be mounted onto a vehicle 10 (e.g., a truck, tractor, or a compact vehicle). Vehicle 10 can guide gutter broom 100 along a variety of surfaces. Gutter broom 100 can be positioned at a side of vehicle 10 to move along curbs or the sides of buildings for cleaning (e.g., sweeping, debris and/or particulate matter removal, etc.) where debris can collect. Vehicle 10 can also move gutter broom 100 along floors in, for example, manufacturing areas or retail environments. Vehicle 10 can support a driver 12 and a drive plate 14. Driver 12 can rotate drive plate 14 and gutter broom 100 supported by drive plate 50 (e.g., via an electric or a hydraulic motor). Gutter broom 100 can rotate about its central axis 20 (i.e., its axis of rotation) to move and/or break down debris or other matter along its path (e.g., weeds, grass, mud, dirt, sand, trash, etc.). Central axis 20 can be generally perpendicular to the path along which gutter broom 100 moves (e.g., surfaces to be cleaned). In an aspect, central axis 20 can be generally vertical. Gutter broom 100 can be positioned to be generally horizontal as it rotates about the generally vertical central axis 20.

Figure 2:
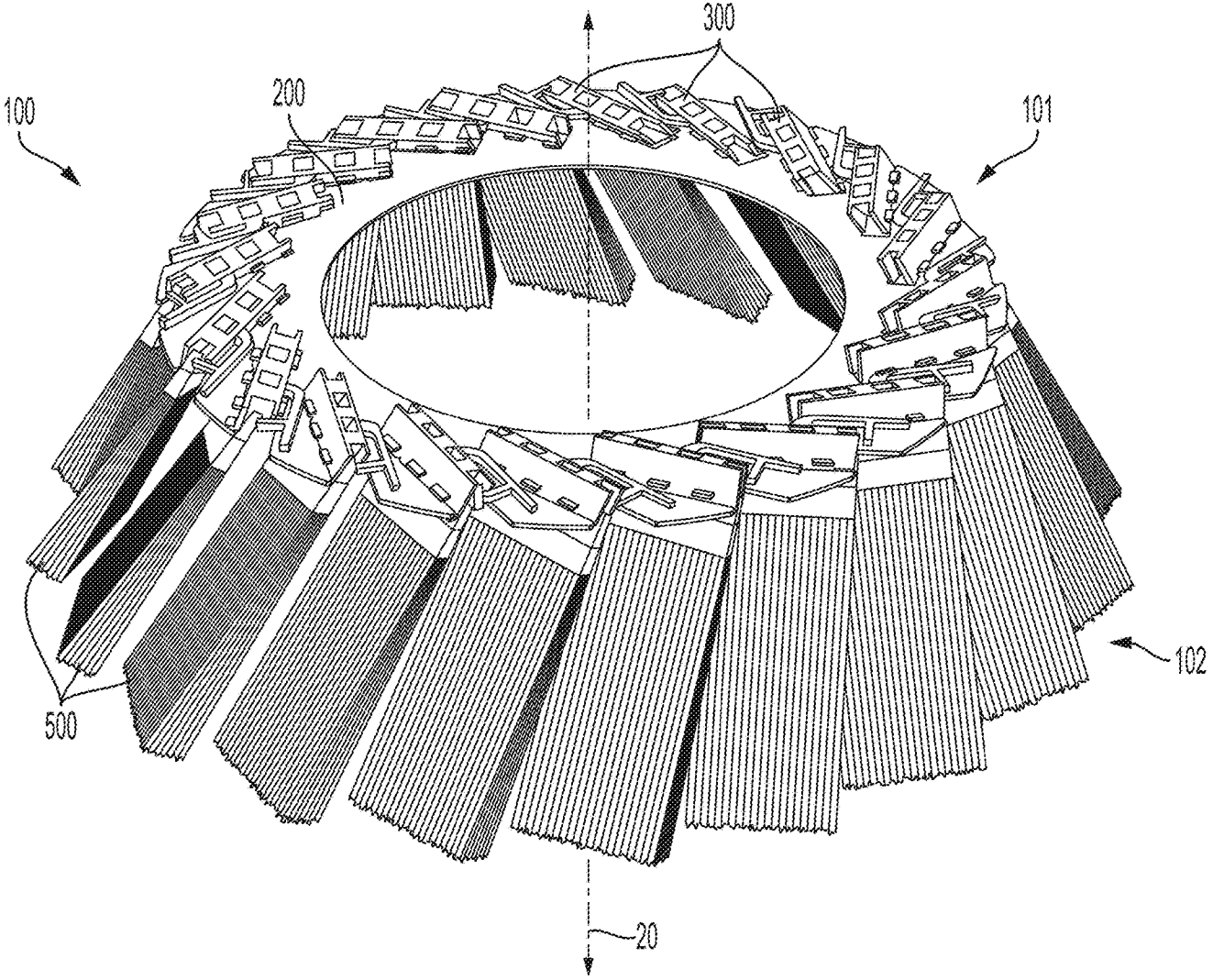
FIG. 2 is a perspective view of the gutter broom of FIG. 1A.
Figure 3:
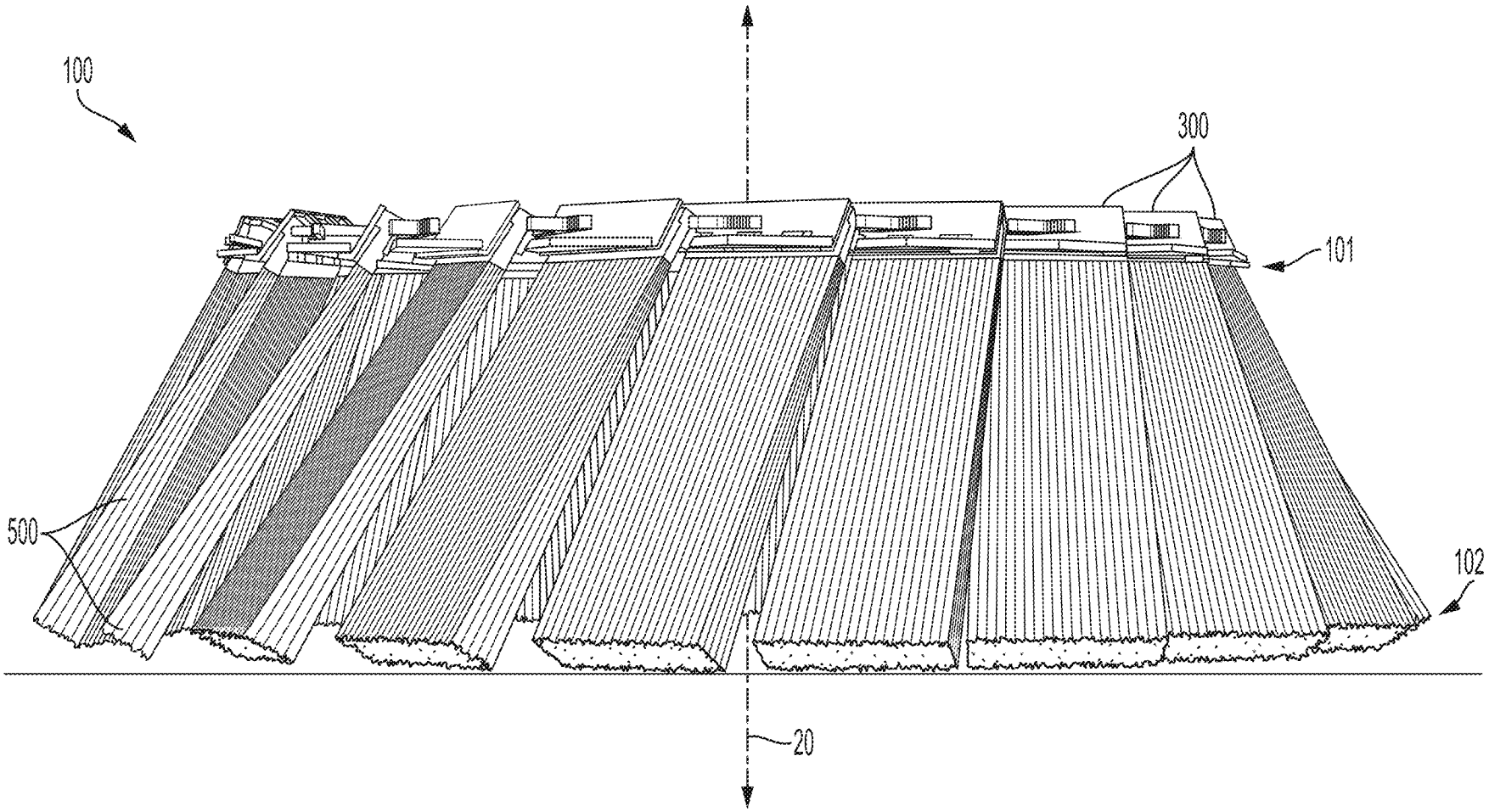
FIG. 3 is a side view of the gutter broom of FIG. 1A.

As shown in FIGS. 2-3, gutter broom 100 can include a mandrel 200 (i.e., a driven plate) that can support one or more carriers 300 and one or more bristle strips 500 (i.e., strips, broom segments, broom attachments, brush, bristles, etc.). Each carrier 300 can retain and support a bristle strip 500. In this way, carriers 300 can be sleeves or receptacles for bristle strips 500.

Gutter broom 100 can have an upper end 101 and a lower end 102. Upper end 101 of gutter broom 100 can include mandrel 200, which can be fixedly attached to drive plate 14 (e.g., via bolts, adhesive, welding, etc.). In an aspect, mandrel 200 can be directly connected to broom driver 12 such that drive plate 14 is not needed. In some aspects, mandrel 200 can be removable such that it is modular. Lower end 102 of gutter broom 100 can include bristle strips 500 and can contact surfaces for cleaning. In an aspect, gutter broom 100 can be suspended from drive plate 14 such that only lower end 102 of gutter broom 100 can contact surfaces, debris, or other materials.

Bristle strips 500 can comprise material to withstand contact with various surfaces (e.g., concrete and unpaved roads) and debris (e.g., rocks, mud, growth, etc.). In an aspect, each bristle strip 500 can comprise flattened steel wire folded over a steel cable to form the bristles. In some aspects, each bristle strip 500 can include, for example, approximately fifteen to approximately thirty individual wires. The flattened steel wire and/or steel cable can further be encased in steel. In an aspect, the portion of each bristle strip 500 that contacts surfaces can be the steel encasement such that the flattened steel wire does not contact surfaces or debris. In an aspect, the 100% steel composition of the bristle strips 500 can provide a stiffness that supports breaking down and movement of debris along the path of gutter broom 100 while being fully recyclable. Bristle strip 500 will be described in further detail below.

Figure 4:
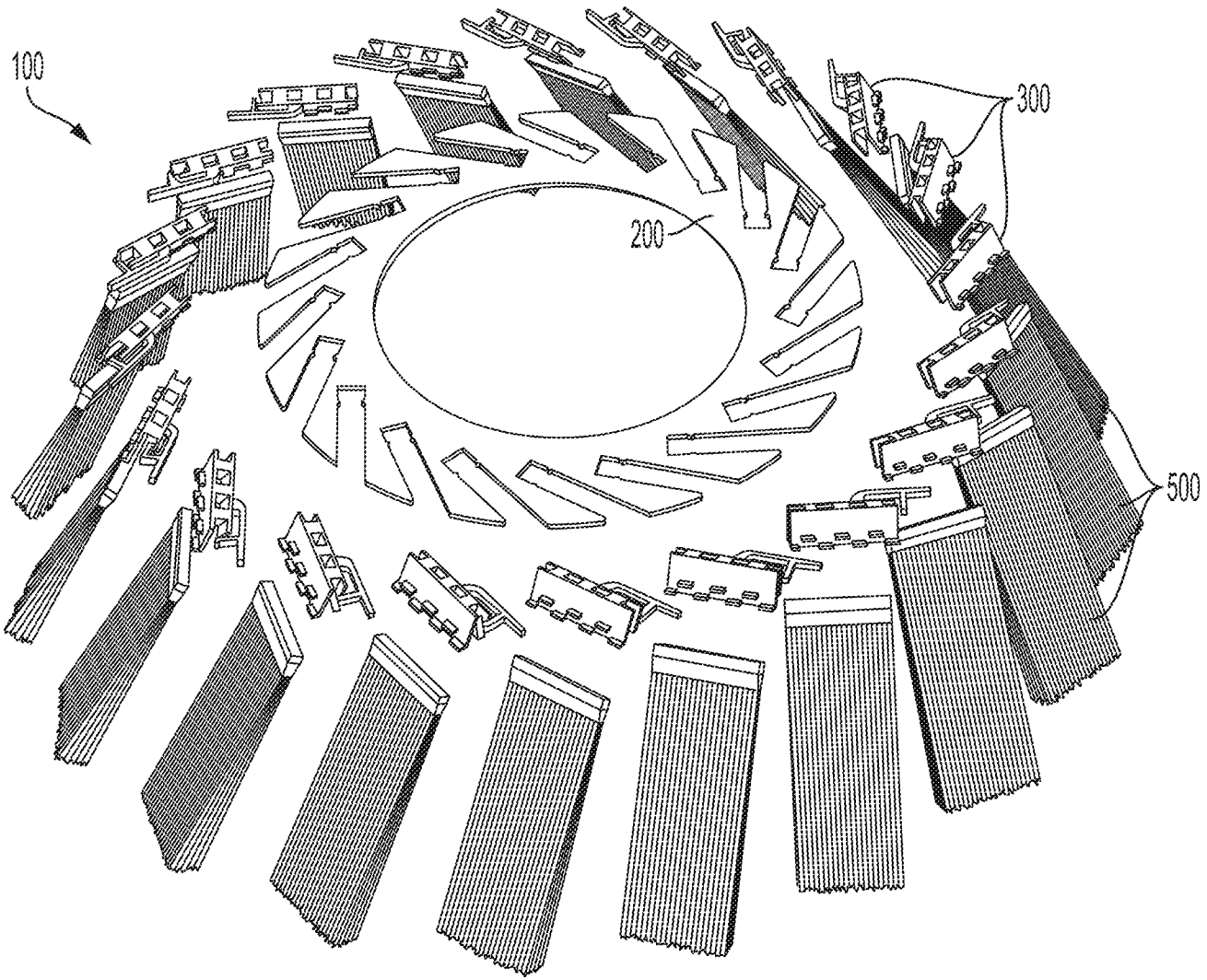
FIG. 4 is an exploded view of the gutter broom of FIG. 1A.

With reference to FIG. 4, in some aspects, gutter broom 100 can support approximately 10 to approximately 35 carriers 300 and bristle strips 500, such as approximately 15 to approximately 30 carriers 300 and bristle strips 500, such as approximately 20 carriers 300 and bristle strips 500. Each carrier 300 can be removably coupled to gutter broom 100. Each bristle strip 500 can be removably coupled to one of the carriers 300 on gutter broom 100. In this way, carriers 300 and bristle strips 500 can be modular. In another aspect, carriers 300 can be integrally formed with mandrel 200. In a further aspect, carriers 300 can be integrally formed with bristle strips 500.

Figure 5:
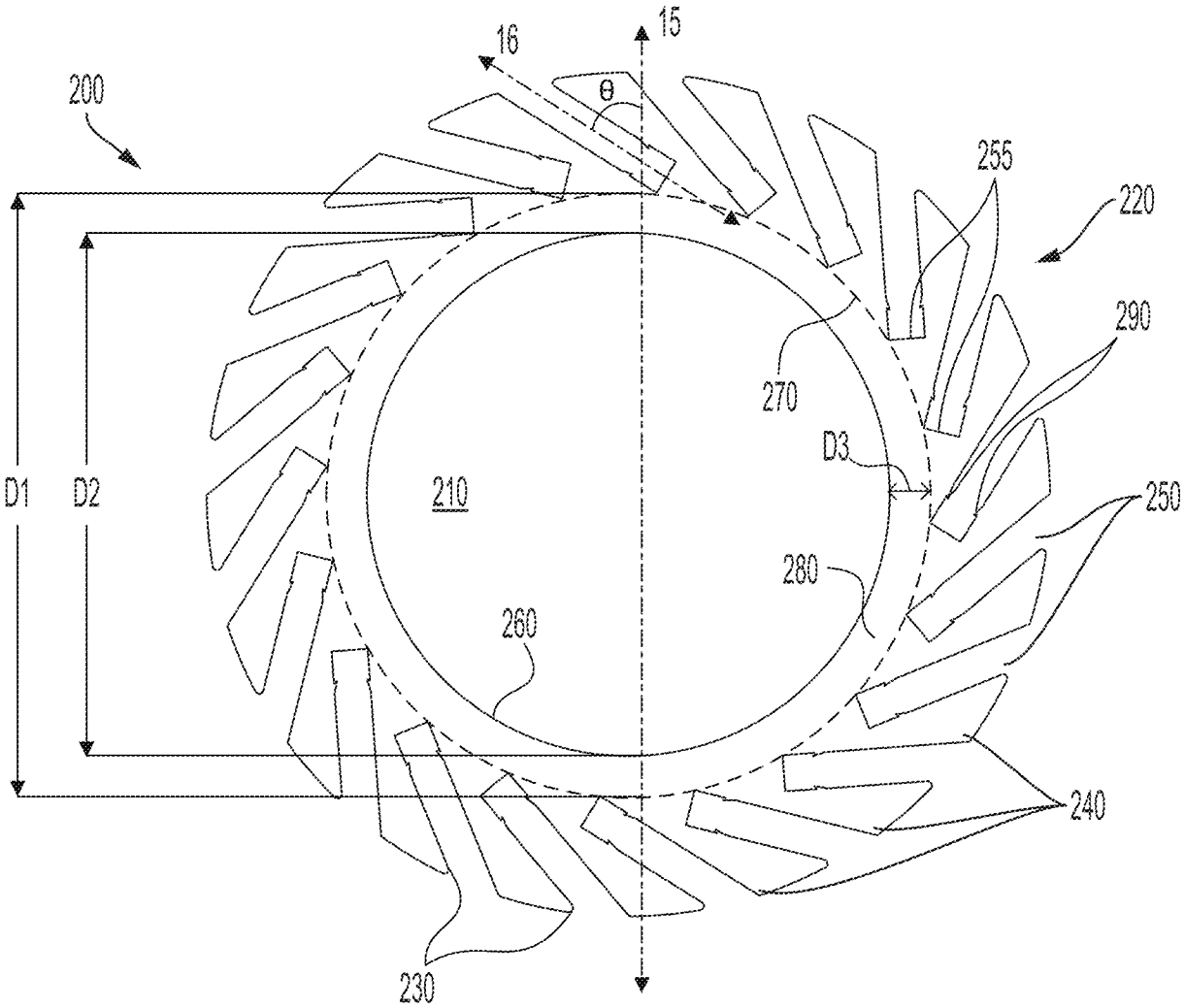
FIG. 5 is a top view of a mandrel according to various aspects.

As shown in FIG. 5, mandrel 200 can include an interior 210, an outer end 220, one or more first outer edges 230, one or more second outer edges 240, one or more channels 250, one or more channel ends 255, an interior edge 260, an inner edge 270 of outer end 220, a tubular portion 280, and one or more carrier detent tabs 290.

In some aspects, mandrel 200 can be circular or arced. In an aspect, mandrel 200 can be of a standard size known in the industry. In some aspects, mandrel 200 can comprise one or more of metals, plastics, composites, ceramics, polymers, natural fibers, etc. For example, mandrel 200 can comprise steel. In an aspect, mandrel 200 can comprise 100% recyclable steel.

In some aspects, interior 210 can be defined by interior edge 260. Interior edge 260 can be a radially interior edge of mandrel 200 at a diameter D2 of mandrel 200. Diameter D2 can be within a range of approximately 50 centimeters to approximately 127 centimeters. Outer end 220 can extend radially outwardly from interior edge 260. Outer end 220 can include the one or more channels 250. In some aspects, a channel 250 can be the opening between a first outer edge 230 and a second outer edge 240. Accordingly, outer end 220 can include one or more first outer edges 230 and corresponding second outer edges 240, with each first outer edge 230 and second outer edge 240 defining the channels 250. In some aspects, first outer edges 230 and second outer edges 240 extend through outer end 220. In some aspects, first outer edges 230 and second outer edges 240 extend radially outwardly from an inner edge 270 of outer end 220. In an aspect, inner edge 270 can be a radial edge of mandrel 200 at a diameter D1 of mandrel 200. Diameter D1 can be within a range of approximately 50 centimeters to approximately 127 centimeters.

Interior edge 260 and inner edge 270 can define a tubular portion 280 of mandrel 200. In some aspects, channels 250 are formed by attaching (e.g., by welding) pieces having first outer edges 230 and second outer edges 240 onto tubular portion 280 of mandrel 200. Accordingly, in some aspects, mandrel 200 is not a unitary piece. In some aspects, a carrier detent tab 290 can extend into a channel 250 by extending from one or both of first outer edge 230 and second outer edge 240 into channel 250. In some aspects, each channel 250 can extend from a channel end 255. Each channel end 255 can meet each first outer edge 230 at inner edge 270 of outer end 220.

In some aspects, channel 250 can extend outwardly from inner edge 270 along a channel axis 16. In an aspect, channel axis 16 can be at a channel angle, θ, from a centerline 15 of mandrel 200. In some aspects, the channel angle, θ, can range from approximately 5 degrees to approximately 85 degrees, such as approximately 20 degrees to approximately 60 degrees, such as approximately 30 degrees. In some aspects, the angled arrangement of channels 250 can reduce contact between adjacent bristle strips 500 while rotating such that bristle strips 500 can be positioned to operate effectively.

In some aspects, interior 210, defined by interior edge 260, can be sized to prevent bristle strips 500 from bending inwardly while rotating in gutter broom 100 around central axis 20. In some aspects, interior 210 defined by interior edge 260 can be sized to prevent each of bristle strips 500 from contacting any adjacent bristle strips 500 while rotating. For example, a larger interior 210 can allow for bristle strips 500 to be spaced farther apart such that contact between adjacent bristle strips 500 is reduced while rotating such that bristle strips 500 can be positioned to operate effectively.

In some aspects, the distance between interior edge 260 and inner edge 270 of outer end 220 can be a distance D3, which is the difference between D1 and D2. This distance can define tubular portion 280 of outer end 220. In some aspects, positioning bristle strips 500 farther outwardly from interior 210 can distance adjacent bristle strips 500. Accordingly, in some aspects, tubular portion 280 between interior edge 260 and inner edge 270 of outer end 220 can reduce contact between adjacent bristle strips 500 while rotating such that bristle strips 500 can be positioned to operate effectively. In some aspects, tubular portion 280 can support outer end 220 and limit its lateral displacement (e.g., as a result of applied weight when mandrel 200 is at least partially filled with carriers 300 and bristle strips 500).

Figure 6:
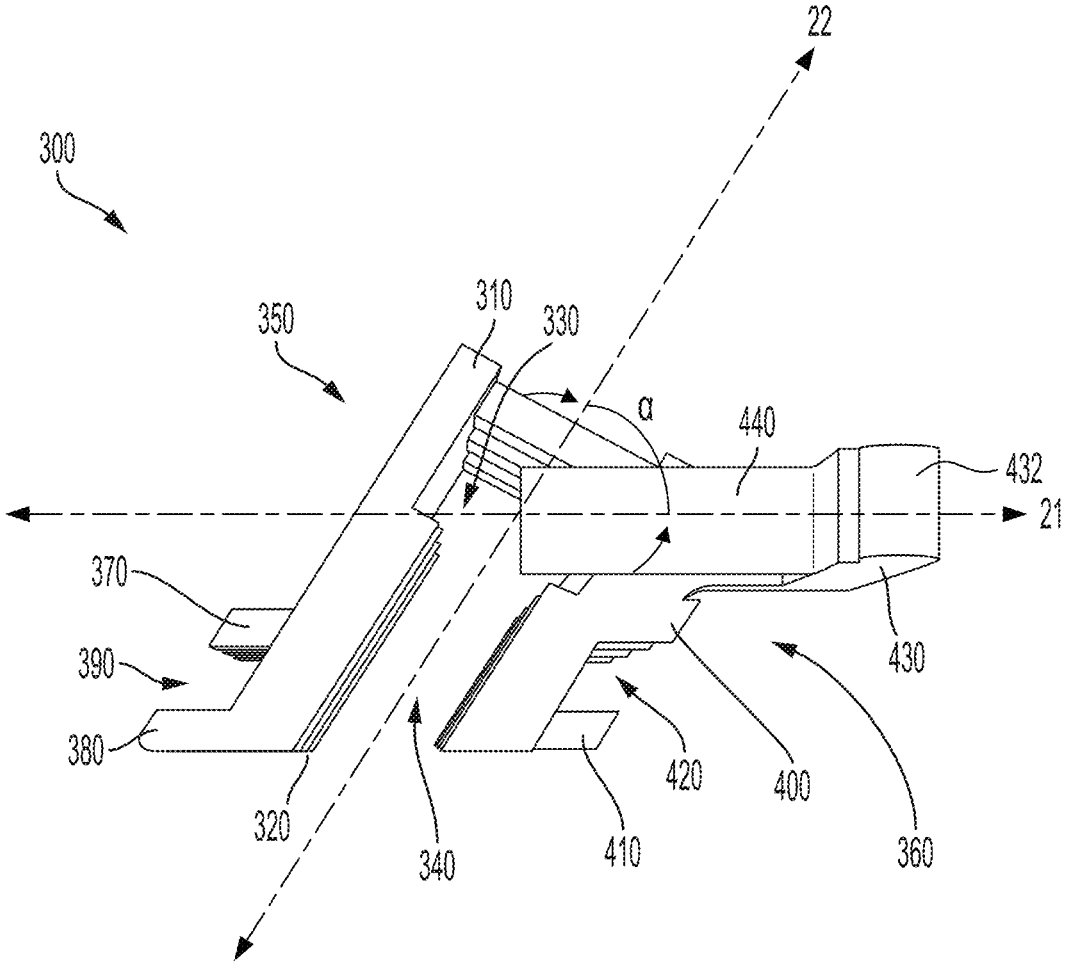
FIG. 6 is a side view of a carrier according to various aspects.
Figure 7:
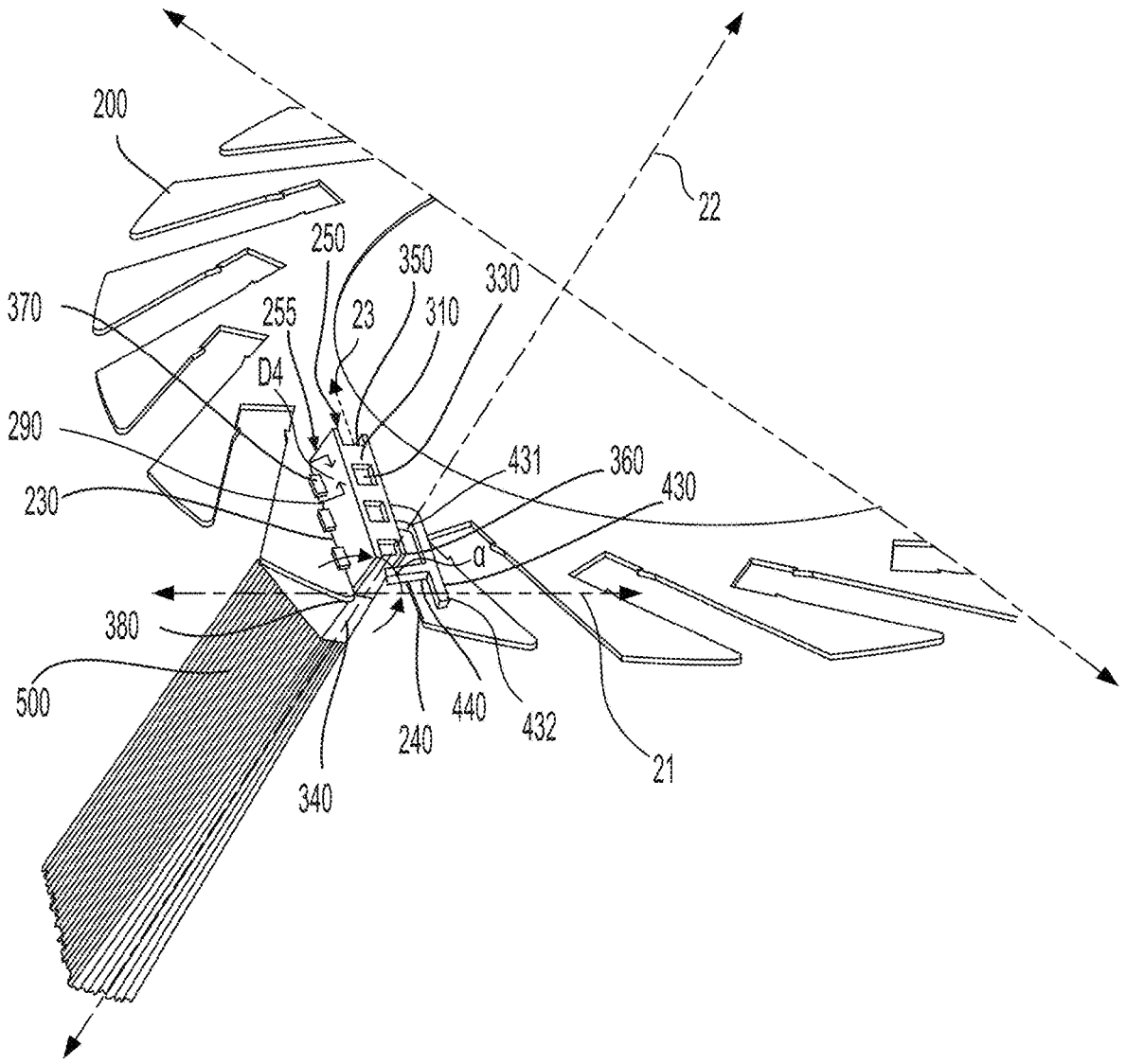
FIG. 7 is a perspective view of a portion of a gutter broom according to various aspects.

With reference to FIGS. 6-7, in some aspects, each carrier 300 can include a first end 350, a second end 360, left rails 370, right rails 380, a left slot 390, and a right slot 420. In some aspects, carrier 300 can include an upper end 310, a lower end 320, an upper cavity 330, a lower cavity 340, a locking member 430 and a lock extension 440. Carriers 300 can be injection molded plastic, in some aspects.

Carriers 300 can be positioned in channels 250 in mandrel 200 and removably coupled to mandrel 200 along first outer edges 230 and second outer edges 240. Each carrier 300 can be positioned at a channel angle θ from centerline 15. In an aspect, each carrier 300 can be positioned at the same channel angle θ. In another aspect, carriers 300 can be positioned at different channel angles θ. In an aspect, each carrier 300 can be arranged in a channel 250 such that lower cavity 340 of carrier 300 can be oriented perpendicular to channel 250 such that bristle strips 500 extend downward from mandrel 200 in a generally vertical direction. In another aspect, each carrier 300 can be arranged in a channel 250 such that lower cavity 340 and or upper cavity 330 of carrier 300 can be oriented obliquely with respect to channel 250 such that bristle strips 500 extend downward from mandrel 200 at an angle. For example, lower cavity 340 and or upper cavity 330 of carrier 300 can extend from mandrel 200 in a lateral direction generally parallel to an axis 22 (FIG. 6). In some aspects, axis 22 can be at an angle, α, from axis 21. Accordingly, carriers 300 can extend from mandrel 200 at an angle, α, from axis 21. In some aspects, the angle, α, can range from approximately 15 degrees to approximately 90 degrees, such as approximately 30 degrees to approximately 75 degrees, such as approximately 60 degrees. Accordingly, each carrier 300 can be arranged at an offset with respect to an adjacent carrier 300.

With reference to FIG. 7, in some aspects, a carrier 300 can be positioned in a channel 250. Carrier detent tabs 290 can engage and retain carrier 300 in channel 250 in a radial direction generally parallel to an axis 23. The engagement of carrier detent tabs 290 and carrier 300 can create a snap fit or an interference fit to retain carrier 300 in channel 250. In some aspects, carrier detent tabs 290 on mandrel 200 can elastically deform a portion of carrier 300 in channel 250 during installation, e.g., by pushing or sliding carrier 300 over carrier detent tabs 290 in a radial direction generally parallel to axis 23 (see also FIG. 10). Once engaged, carrier detent tabs 290 can prevent radial outward movement of carrier 300 from channel 250.

In some aspects, each carrier 300 can include left rails 370. The space between left rails 370 can define left slot 390. Similarly, in some aspects, each carrier 300 can include right rails 380. The space between right rails 380 can define right slot 420. In some aspects, carrier 300 can be disposed in channel 250 and removably coupled to mandrel 200 such that first outer edge 230 can be disposed in left slot 390 between left rails 370, and second outer edge 240 can be disposed in right slot 420 between right rails 380. Accordingly, carrier 300 can surround first outer edge 230 and second outer edge 240 such that carrier 300 extends across mandrel 200 in a tangential direction generally parallel to an axis 21 (i.e., a length of carrier 300 is generally perpendicular to a radial edge of mandrel 200). In some aspects, left rails 370 and right rails 380 can retain carrier 300 in channel 250 in a lateral direction generally parallel to axis 22. In this way, carrier 300 can be maintained in channel 250 in the lateral direction while rotating in gutter broom 100 around central axis 20 because left rails 370 and right rails 380 can prevent lateral movement.

Figure 8:
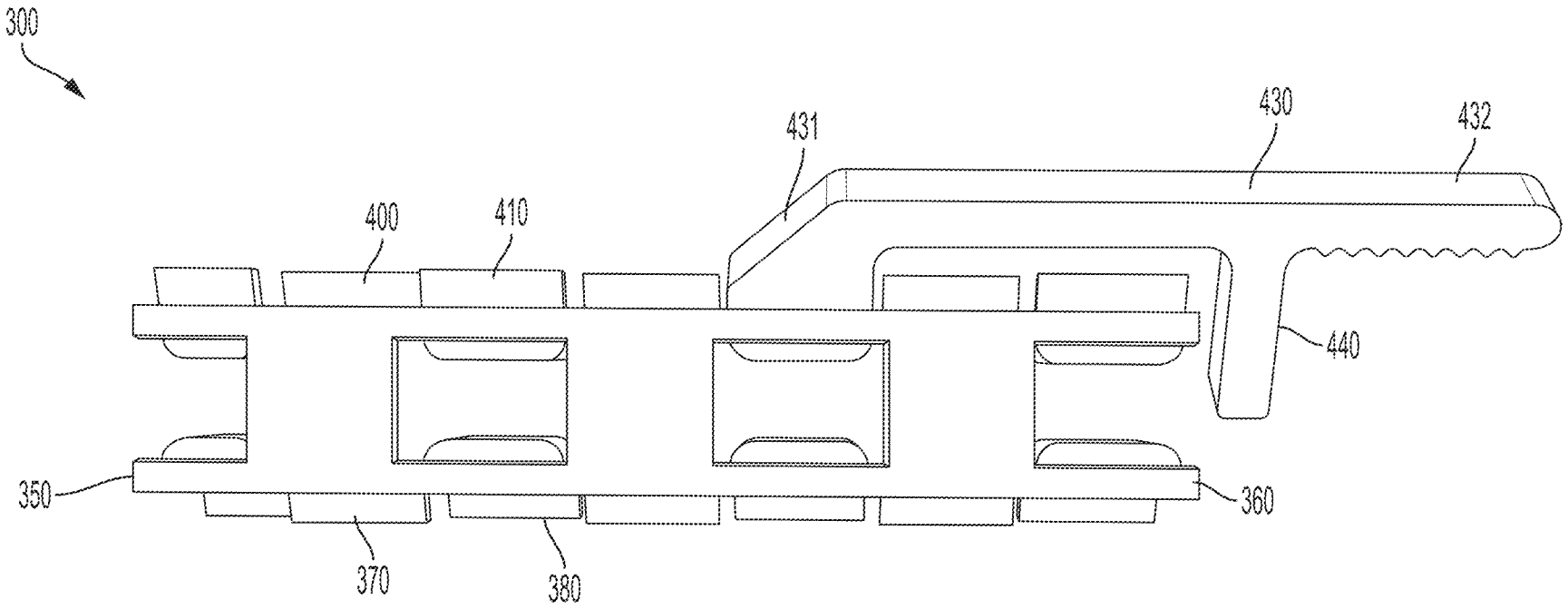
FIG. 8 is a top view of the carrier of FIG. 6.

In some aspects, carriers 300 can extend radially outward from mandrel 200. In these aspects, each carrier 300 can be slidably arranged in a channel 250. In an aspect, left slot 390 and right slot 420 allow carrier 300 to slide over first outer edge 230 and second outer edge 240. In an aspect, pushing or sliding carrier 300 over carrier detent tabs 290 for approximately a distance D4 represents the extent to which carrier 300 can be radially disposed in channel 250. Channel end 255 can provide an abutment at this most forward radial position of carrier 300 in channel 250. With reference to FIG. 8, in some aspects, first end 350 of carrier 300 can abut channel end 255 at this most forward radial position of carrier 300 in channel 250.

As shown in FIG. 8, in some aspects, locking member 430 can be cantilevered. In an aspect, locking member 430 can have an attached end 431 and a free end 432. In an aspect, attached end 431 can secure locking member 430 to a surface of carrier 300. Free end 432 can be unattached and can extend away from first end 350 of carrier 300 towards second end 360. In an aspect, free end 432 can include ridges and or knurling to allow a user to better grip free end 432 during removal and installation of a bristle strip 500. In some aspects, lock extension 440 of locking member 430 can extend transversally from free end 432. In this aspect, lock extension 440 can extend across second end 360 of carrier 300. Accordingly, lock extension 440 can extend across second end 360 in a tangential direction generally parallel to axis 21 (i.e., lock extension 440 is positioned generally perpendicular to second end 360, which extends generally parallel to axis 22). In this way, lock extension 440 can prevent bristle strip 500 positioned in carrier 300 from moving radially outwardly. Conversely, lock extension 440 can be pivoted away from second end 360 to allow bristle strip 500 to move radially outwardly, e.g., for servicing or replacement.

Figure 9:
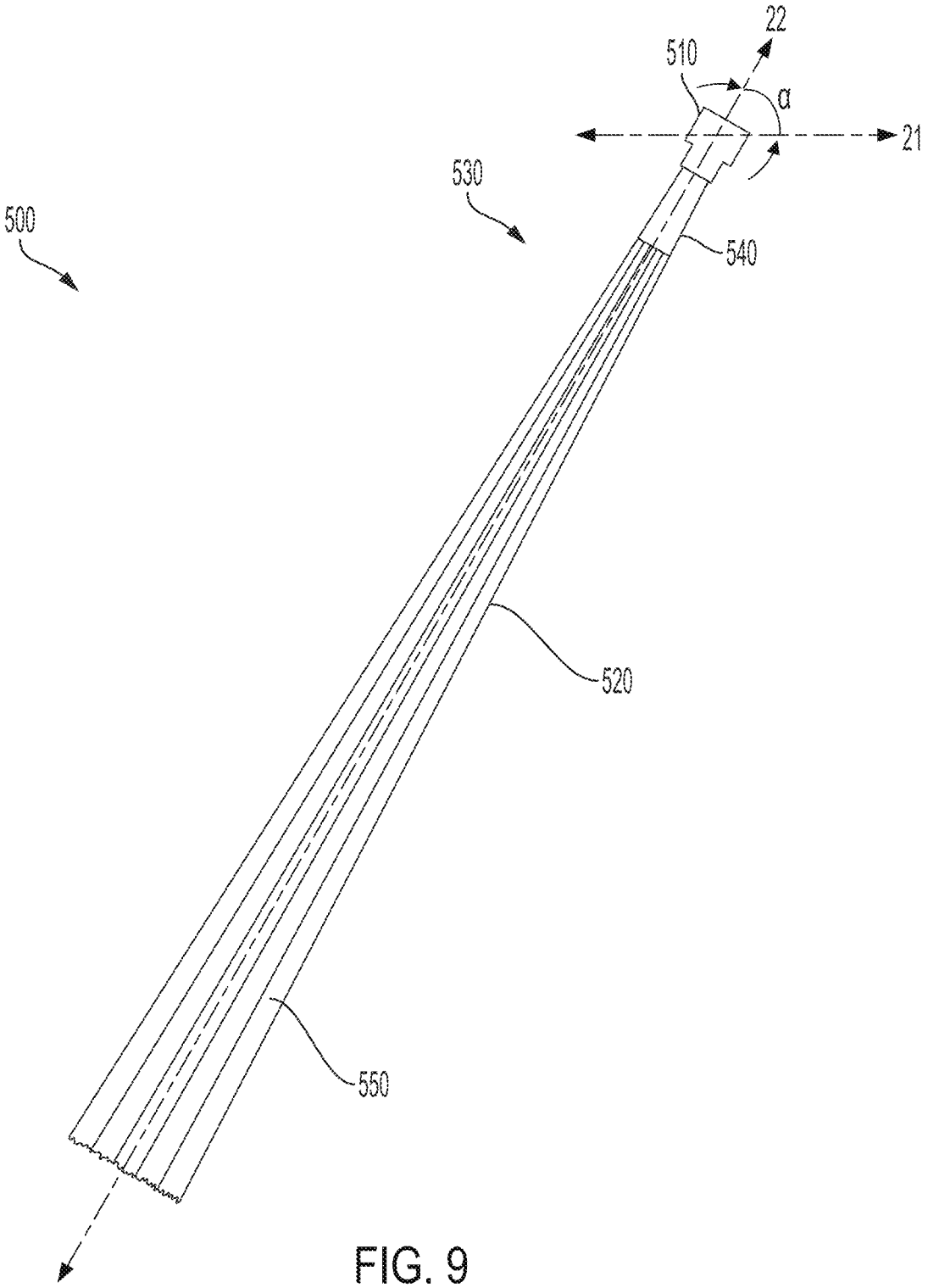
FIG. 9 is a side view of a bristle strip according to various aspects.

As shown in FIG. 9, a bristle strip 500 can include an upper end 510, a lower end 520, a first end 530, a second end 540, and an insert 550. In some aspects, bristle strip 500 can be manufactured continuously in a roll forming operation.

In some aspects, each bristle strip 500 can include, for example, approximately fifteen to approximately thirty individual bristles. As discussed above, in an aspect, each bristle strip 500 can include bristles folded over a cable. For example, the bristle strip 500 can comprise flattened steel wire folded over a steel cable. In some aspects, the bristles can be folded in half over a cable of approximately 13 centimeters (or 5 inches) in length. In other aspects, the bristles can instead be folded over a composite "core" (i.e., a center mass). In an aspect, bristle strip 500 can comprise bristles of approximately 13 centimeters (or 5 inches) in length. In one aspect, individual bristles of bristle strip 500 can be approximately 0.2 centimeter to approximately 0.4 centimeter wide, and approximately 0.05 centimeter to approximately 0.11 centimeter hardened spring steel. In another aspect, the bristles can be compacted cable between approximately 0.3 centimeter and approximately 1.2 centimeters in diameter.

The bristles and cable can further be encased, such as in steel. The encasement can be insert 550. In some aspects, insert 500 can prevent bristles from contacting surfaces. In some aspects, the encasement for insert 550 can be cut every six inches. In some aspects, the bristles can be wrapped in a steel casing that is approximately 0.05 centimeter to approximately 0.26 centimeter thick sheet steel. As discussed above, bristle strip 500 can be 100% recyclable steel. In some aspects, upper end 510 of each bristle strip 500 can have a larger cross-sectional area due to the cable. The larger cross-sectional area can allow bristle strip 500 to fit tightly into insert 550. In an aspect, lower end 520 of each bristle strip 500 can extend down from upper end 510 and can be unattached (i.e., not coupled to any other component). In an aspect, lower end 520 can have a sharp leading edge to better move and/or break down debris along the path of gutter broom 100.

In some aspects, bristle strips 500 can comprise one or more of metals, plastics, composites, ceramics, polymers, natural fibers, etc. For example, bristle strips 500 can comprise steel, aluminum, nylon, polyester, polypropylene, PVC, vegetable fibers, or hairs. Other aspects provide that bristle strips 500 can be composed of other materials, or a blend of materials. For example, a bristle strip 500 can have a steel and polypropylene mix. In another aspect, the bristles can comprise polyurethane or other composite material that is approximately 0.1 centimeter to approximately 0.21 centimeter in diameter. In some aspects, the bristles can be round, and straight or crimped.

In some aspects, one or more bristle strips 500 can have different properties based on the types of bristles contained in bristle strip 500. For example, including different types of bristle strips 500 having different properties in gutter broom 100 can advance and customize cleaning for one or more specific surfaces. For example, gutter brooms generally can be used outdoors to clean streets that require different types or levels of contact (e.g., abrasive or fine). Streets can vary in granularity and can be made from various materials, e.g., concrete, brick, cobblestone, and/or asphalt, each requiring different cleaning methods. Streets can also include growth, such as patches of grass or weeds. In another example, streets can have other natural debris, such as sand, mud, and rocks, or non-natural debris, such as trash and recyclables. Accordingly, cleaning by gutter broom 100 can be enhanced to effectively clean these distinct surfaces, growth, and/or debris. Gutter broom 100 can also be customized by including fewer bristle strips 500. For example, bristle strips 500 can be omitted from mandrel 200 to create a paddle-type contact with surfaces, e.g., to clean around snow. In another aspect, bristle strips 500 can vary in bristle length (e.g., bristles in bristle strip 500 can have different lengths), which can improve cleaning of intermediate surfaces. In this aspect, the surface contacting profile of bristle strip 500 can be customized to clean one or more surfaces.

In some aspects, gutter broom 100 can include bristle strips 500 of different materials to advance and customize cleaning. In some aspects, bristle strips 500 of different materials can be included in gutter broom 100 to leverage properties of each material. In other aspects, bristle strips 500 can be blended, such as by including both steel and polypropylene.

In some aspects, bristle strips 500 can vary in stiffness to advance and customize cleaning. For example, bristle strips 500 having a greater stiffness can provide abrasive contact to better target certain debris, such as growth along streets and compacted mud. Accordingly, bristle strips 500 can be useful for aggressive cleaning to target debris that can be tougher to move and/or break down (i.e., cut), such as growth, compacted mud, rocks, etc. The higher stiffness can reduce buckling and provide an inertial impact to move tougher debris. Bristle strips 500 having a higher stiffness that are arranged together (e.g., grouped or adjacently) can grip and/or break down tougher debris more effectively. Bristle strips 500 having a lower stiffness can provide can provide a finer contact. Accordingly, bristle strips 500 can be useful for finer cleaning to target separations between various surfaces. Greater movement and flexibility can be realized at impact such that first bristle strips 500 can buckle to reach crevices, granularity, gaps, etc. Additionally, bristle strips 500 can better target lighter debris (e.g., sand) and particulate matter. In some aspects, gutter broom 100 can include bristle strips 500 having varying stiffness to provide both abrasive and fine contact with surfaces. Stiffness can be determined by material, diameter, cross-sectional area, cross-section geometry, wall thickness, outer layers, coatings for reinforcement, ribbing, elasticity openings, etc. For example, bristle strips 500 comprising steel can be crimped to provide greater stiffness. Bristle strips 500 can have a cross-sectional geometry that is circular, elliptical, rectangular, or a star, plus sign, etc.

Figure 10:
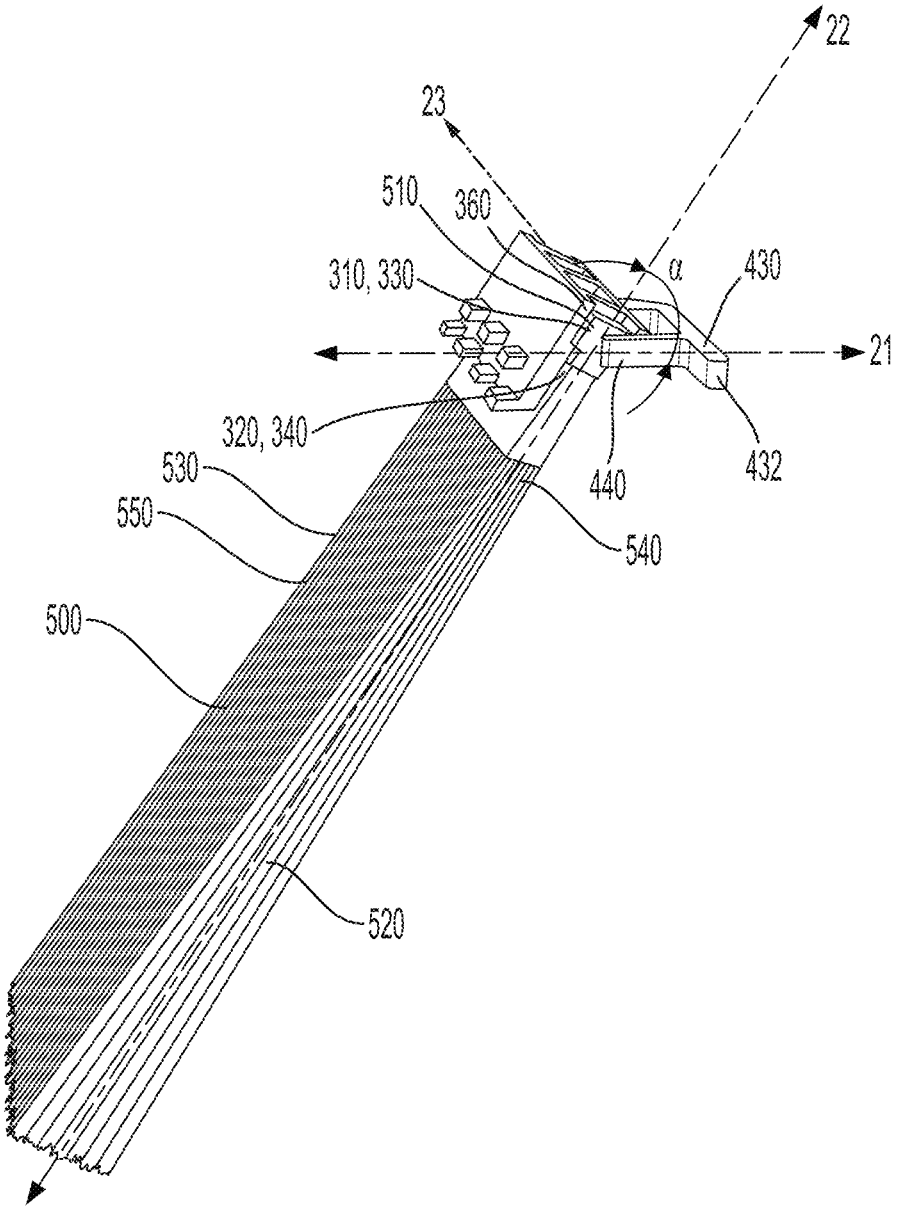
FIG. 10 is a perspective view of a carrier and a bristle strip according to various aspects.

With reference to FIGS. 9-10, bristle strips 500 can be removably coupled to carriers 300, for example, by sliding bristle strips 500 into carriers 300. In some aspects, each bristle strip 500 can be arranged in carrier 300 such that bristle strip 500 can also be oriented obliquely with respect to mandrel 200 and channel 250. In some aspects, bristle strips 500 can be pushed or slid into carriers 300 in a radial direction generally parallel to axis 23. Accordingly, similar to carriers 300, when bristle strips 500 are removable coupled to carriers 300, bristle strips 500 can extend both upward and downward from mandrel 200 in a lateral direction generally parallel to axis 22. In this way, bristle strips 500 can extend from mandrel 200 at angle, a, from axis 21 such that each bristle strip 500 can be arranged at an offset with respect to an adjacent bristle strip 500. The offset of each bristle strip 500 can prevent each of bristle strips 500 from contacting an adjacent bristle strip 500 while rotating in gutter broom 100 around central axis 20. Additionally, as discussed above, in an aspect, because of the angled arrangement of bristle strips 500, as gutter broom 100 rotates about central axis 20, each bristle strip 500 can wear more evenly. Because of the distributed wear, bristle strips 500 having similar properties can require replacement at the same time.

With reference to FIGS. 7 and 10, in some aspects, carrier 300 can be slidably arranged in channel 250 by surrounding first outer edge 230 and second outer edge 240 of mandrel 200. Carrier 300 can slide over first outer edge 230 and second outer edge 240 of mandrel 200 such that upper end 310 of carrier 300 can extend upward from mandrel 200 and lower end 320 of carrier 300 can extend downward from mandrel 200. In an aspect, upper end 310 of carrier 300 can include locking member 430. The space within upper end 310 can include upper cavity 330. Lower end 320, can define the opposing end of carrier 300 from upper end 310, and similarly can include lower cavity 340.

In some aspects, each of bristle strips 500 can be received within upper cavity 330 and lower cavity 340 of one of carriers 300. In an aspect, upper end 510 of bristle strip 500 can be received within upper cavity 330, and lower end 520 of bristle strip 500 can be received within lower cavity 340.

With reference to FIGS. 9-10, in an aspect, upper end 510, having a larger cross-sectional area, can fill upper cavity 330. This can create a press fit such that upper end 510 can be secured within upper cavity 330 and, consequently, bristle strip 500 can be secured in carrier 300. In other aspects, bristle strip 500 can be secured in carrier 300 by snaps, adhesive, or another attachment method. In some aspects, bristle strip 500 can be secured in carrier 300 such that first end 530 of bristle strip 500 can abut first end 350 of carrier 300, which, as discussed above, can abut channel end 255. Second end 540 can define the opposing end of first end 530 and similarly abut second end 360 of carrier 300. In some aspects, upper end 510 of bristle strip 500, having a larger cross-sectional area, can expand within upper cavity 330 of carrier 300 such that movement of bristle strip 500 in a lateral direction generally parallel to axis 22 can be prevented. In some aspects, lock extension 440 can extend across upper end 310 of carrier 300, and, consequently, upper cavity 330 of carrier 300. Accordingly, if bristle strip 500 is secured in carrier 300, lock extension 440 can extend across second end 360 of carrier 300 and second end 540 of bristle strip 500. This can prevent movement of bristle strip 500 in a radial direction generally parallel to axis 23.

Figure 11:
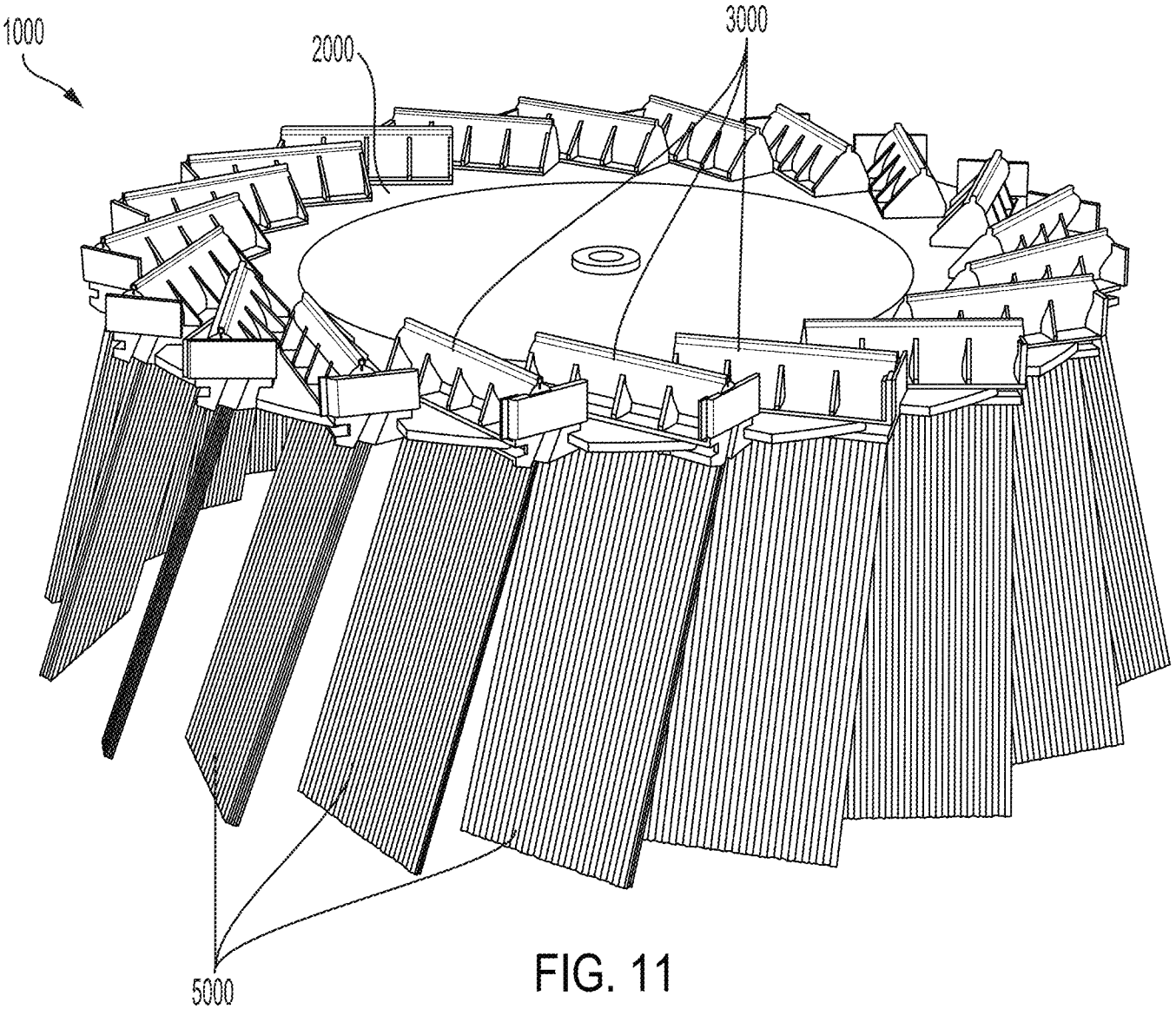
FIG. 11 is a perspective view of a gutter broom according to various aspects.

As shown in FIG. 11 in another example, in some aspects, a gutter broom 1000 can include a mandrel 2000 that can support one or more carriers 3000 and one or more bristle strips 5000. Gutter broom 1000 and its components can be similar to gutter broom 100 discussed above.

Figure 13:
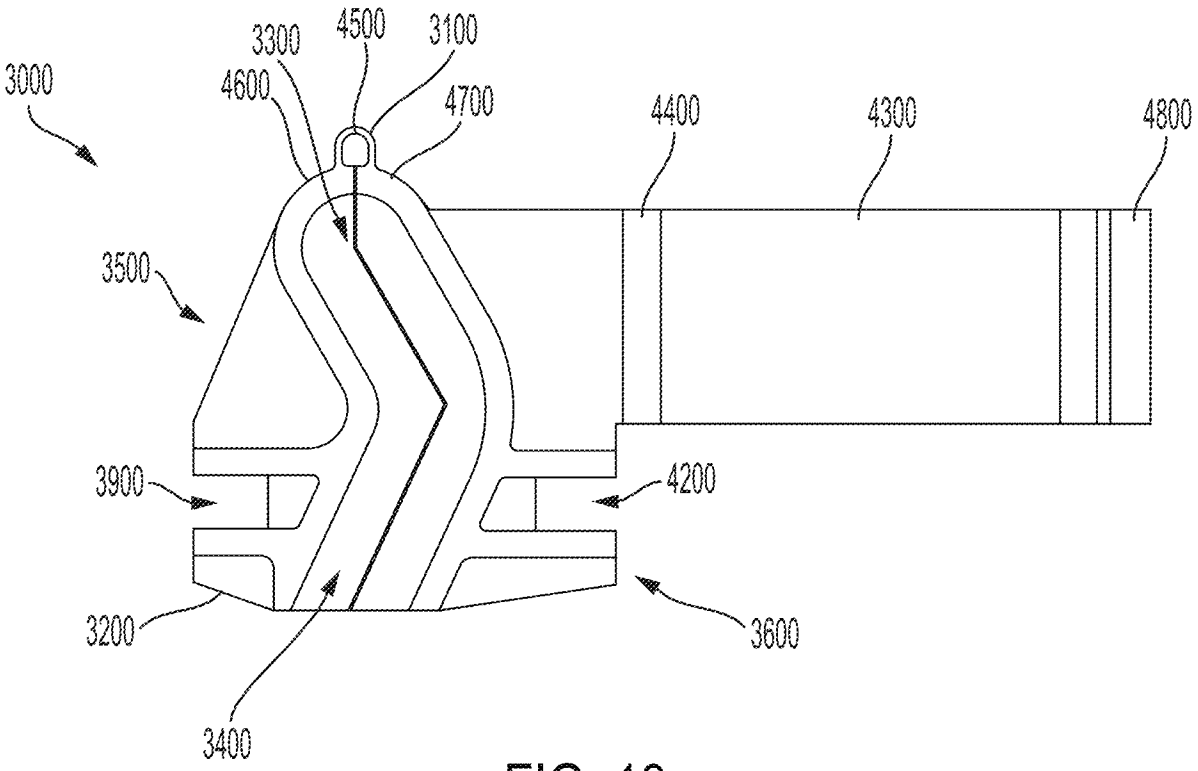
FIG. 13 is a side view of the carrier of FIG. 12.

With reference to FIGS. 12-13, in some aspects, each carrier 3000 can include a left slot 3900, and a right slot 4200. In some aspects, carrier 3000 can include an upper end 3100, a lower end 3200, an upper cavity 3300, a lower cavity 3400, a first end 3500, a second end 3600, a left side 4600, a right side 4700, a carrier hinge 4500, a lock 4300, a lock hinge 4400, a lock end 4800, and a lock tab 4900. Carriers 3000 can be injection molded plastic, in some aspects. Carriers 3000 can be removably coupled onto gutter broom 1000 similar to carriers 300 on gutter broom 100.

Figure 14:
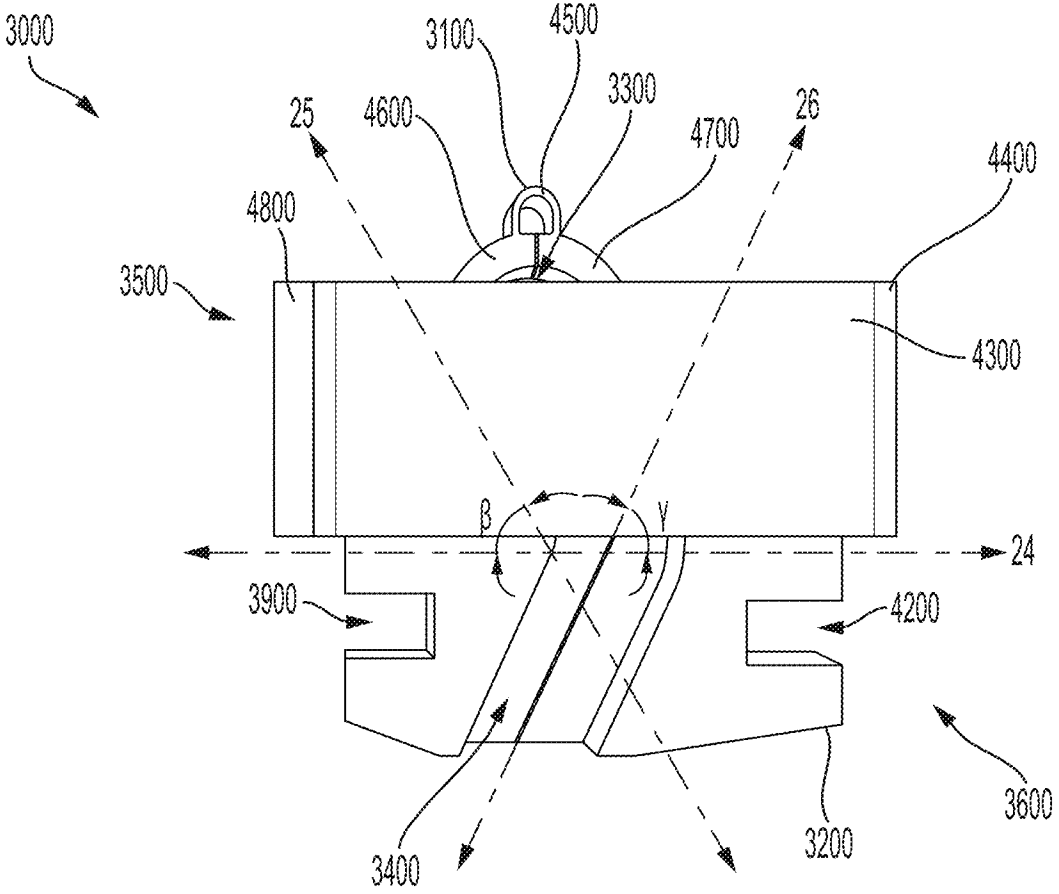
FIG. 14 is a side view of the carrier of FIG. 12.

With reference to FIGS. 11 and 14, in some aspects, carriers 3000 can be oriented obliquely with respect to mandrel 2000. For example, carriers 3000 can extend upward in a lateral direction generally parallel to an axis 25. In some aspects, axis 25 can be at an angle, (3, from axis 24. Accordingly, carriers 3000 can extend upward from mandrel 2000 at an angle, (3, defined between axis 24 and axis 25. Similarly, carriers 3000 can extend downward from mandrel 2000 in a lateral direction generally parallel to an axis 26. In some aspects, axis 26 can be at an angle, γ, from axis 24. Accordingly, carriers 3000 can extend downward from mandrel 2000 at an angle, γ, defined between axis 24 and axis 26. In this way, the sum of angle, (3, and angle, γ, defines the angle between upper end 3100 and lower end 3200 of each carrier 3000. In some aspects, the angle, β, and the angle, γ, from axis 24 can range from approximately 15 degrees to approximately 90 degrees, such as approximately 30 degrees to approximately 75 degrees, such as approximately 60 degrees. In this way, upper end 3100 and lower end 3200 of each carrier 3000 can be offset with respect to an adjacent carrier 3000 upper end 3100 and lower end 3200, respectively. In some aspects, carrier 3000 can be disposed in channel 2500 and removably coupled to mandrel 2000 via left slot 3900 on left side 4600 and right slot 4200 on right side 4700. In an aspect, left slot 3900 and right slot 4200 can allow carrier 3000 to slide over mandrel 2000. In some aspects, left side 4600 and right side 4700 surrounding mandrel 2000 disposed in left slot 3900 and right slot 4200 can retain carrier 300 in channel 2500 in a lateral direction generally parallel to axis 25 or axis 26. Accordingly, carrier 3000 can be maintained in channel 2500 in the lateral direction while rotating in gutter broom 1000. In other aspects, carrier 3000 can be coupled to mandrel 2000 by snaps, adhesive, or another attachment method. In an aspect, carrier 3000 can surround mandrel 2000 such that it extends across mandrel 200 in a tangential direction generally parallel to an axis 24 (i.e., a length of carrier 3000 is generally perpendicular to a radial edge of mandrel 2000).

As shown in FIGS. 15A-B, in some aspects, left side 4600 and right side 4700 can be hingedly attached to each other via carrier hinge 4500. Accordingly, carrier 3000 can be a clamshell such that left side 4600 and right side 4700 can pivot relative to each other. Due to manufacturing constraints, this hinged carrier can allow for more complex internal geometries to better couple to mandrel 2000 and/or bristle strip 5000. In another aspect, carrier 3000 can be additively manufactured such that carrier hinge 4500 is not necessary.

With reference to FIGS. 11 and 16, to dispose carrier 3000 in channel 2500, left side 4600 and right side 4700 can pivot inwardly about carrier hinge 4500 and slide over mandrel 2000 via left slot 3900 and right slot 4200. The inward pivot can allow carrier 3000 to clear carrier detent tabs 2900 (see FIG. 5 for carrier detent tabs 290) such that first end 3500 of carrier 3000 can be radially inward of carrier detent tabs 2900 when carrier 3000 is disposed in channel 2500. In some aspects, left side 4600 and right side 4700 can be biased to pivot outwardly. Accordingly, once carrier 3000 is disposed in channel 2500, left side 4600 and right side 4700 can pivot outwardly and engage with carrier detent tabs 2900 via left slot 3900 and right slot 4200. The engagement can retain carrier 3000 in channel 2500. In this way, carrier 3000 can be secured in a radial direction generally parallel to axis 27. In some aspects, carriers 3000 can include an additional securing mechanism, such as a tab similar to carrier detent tabs 2900 that can contact mandrel 2000 and maintain carrier 3000 in channel 2500.

With reference to FIG. 14, in some aspects, lock 4300 can extend across carrier 3000 in a tangential direction generally parallel to axis 24 (i.e., lock 4300 is positioned generally perpendicular to second end 3600, which extends generally parallel to axes 25 and 26). In this way, lock 4300 can prevent bristle strip 5000 positioned in carrier 3000 from moving radially outwardly. Conversely, lock 4300 can be pivoted away from second end 3600 to allow bristle strip 5000 to move radially outwardly, e.g., for servicing or replacement.

With reference to FIGS. 15A-16, in this aspect, lock 4300 can extend across second end 3600 of carrier 3000, which can be at the opposite end of carrier 3000 from first end 3500. In some aspects, lock end 4800 can engage with lock tab 4900 of carrier 3000 to securely close across second end 3600 of carrier 3000. In an aspect, lock end 4800 can be clipped or snapped onto lock tab 4900 of carrier 3000 (or otherwise latched). Because of the engagement between lock end 4800 and lock tab 4900, lock 4300 can be secured in a radial direction generally parallel to axis 27. In an aspect, lock 4300 can pivot away from second end 3600 of carrier 3000 via lock hinge 4400 (i.e., lock 4300 can be released). Lock 4300 can be moved away from second end 3600 of carrier 3000 at any time during the life of gutter broom 1000, including when carrier 3000 is coupled to mandrel 2000 and when gutter broom 1000 is mounted to and suspended from a vehicle (e.g., vehicle 10). In this way, bristle strips 5000 can be accessed for replacement when needed.

As shown in FIGS. 17 and 23, bristle strip 5000 for gutter broom 1000 can be pre-folded (e.g., bent or curved prior to being inserted into carrier 3000). In this way upper end 3100 and lower end 3200 can extend relative to each other such that bristle strip 5000 does not extend generally along axis 25 or axis 26 in its entirety. This geometry can increase friction between bristle strip 5000 and carrier 3000 when bristle strip 5000 is positioned in carrier 3000 for better retention of bristle strip 5000 within carrier 3000.

With reference to FIGS. 11, 17-18, and 23, bristle strips 5000 can be removably coupled to carriers 3000. In some aspects, each bristle strip 5000 can be arranged in carrier 3000 such that bristle strip 5000 can also be oriented obliquely with respect to mandrel 2000 and channel 2500. In some aspects, bristle strips 5000 can be pushed or slid into carriers 3000 in a radial direction generally parallel to axis 27. Accordingly, similar to carriers 3000, when bristle strips 5000 are removably coupled to carriers 3000, bristle strips 5000 can extend both upward and downward from mandrel 2000 in a lateral direction generally parallel to axis 25 and axis 26, respectively. Specifically, upper end 3100 of carrier 3000 can extend upward from mandrel 2000 and lower end 3200 of carrier 3000 can extend downward from mandrel 2000. In aspects, a portion of bristle strips 5000 can extend from mandrel 2000 upward at angle, β, defined between axis 24 and axis 25, and another portion can extend downward at angle, γ, defined between axis 24 and axis 26. In this way, the sum of angle, β, and angle, γ, defines the angle between upper end 5100 and lower end 5200 of bristle strips 5000. In some aspects, angle, β, and angle, γ, each can range from approximately 15 degrees to approximately 90 degrees, such as approximately 60 degrees to approximately 75 degrees, such as approximately 30 degrees to approximately 40 degrees, such as approximately 60 degrees (FIG. 17), such as approximately 30 degrees (FIG. 23). Accordingly, in some aspects, the angle between upper end 5100 and lower end 5200 of bristle strips 5000 can range from approximately 30 degrees to approximately 180 degrees, such as approximately 120 degrees to approximately 150 degrees, such as approximately 60 degrees to approximately 80 degrees, such as approximately 120 degrees (FIG. 17), such as approximately 60 degrees (FIG. 23). In this way, each bristle strip 5000 can be arranged at an offset with respect to an adjacent bristle strip 5000. The offset of each bristle strip 5000 can prevent each of bristle strips 5000 from contacting any adjacent bristle strips 5000 while rotating in gutter broom 1000.

With reference to FIGS. 16-18, and 23, in an aspect, upper end 3100 of carrier 3000 can include lock 4300. The space within upper end 3100 can include upper cavity 3300. Lower end 3200, can define the opposing end of carrier 3000 from upper end 3100, and similarly can include lower cavity 3400. In some aspects, each of bristle strips 5000 can be received within upper cavity 3300 and lower cavity 3400 of one of carriers 3000. In an aspect, upper end 5100 of bristle strip 5000 can be received within upper cavity 3300, and lower end 5200 of bristle strip 5000 can be received within lower cavity 3400. In an aspect, bristle strip 5000 can be bent such that when bristle strip 5000 is slid into carrier 3000, upper end 3100 can fit the shape of upper cavity 3300 and lower end 3200 can fit the shape of lower cavity 3400 such that bristle strip 5000 can be press fit into carrier 3000. Accordingly, movement of bristle strip 5000 in a lateral direction generally parallel to axis 25 or axis 26 can be prevented. In this way, when left side 4600 and right side 4700 of carrier 3000 pivot outwardly to engage carrier detent tabs 2900, upper cavity 3300 and lower cavity 3400 can be shaped to receive and retain bristle strip 5000. The friction between and geometry of carrier 3000 and bristle strip 5000 can laterally retain bristle strip 5000.

In some aspects, lock 4300 can extend across second end 3600 of carrier 3000, and, consequently, upper cavity 3300 of carrier 3000. Accordingly, if bristle strip 5000 is secured in carrier 3000, lock 4300 can extend across second end 3600 of carrier 3000 and second end 5400 of bristle strip 5000. This can prevent movement of bristle strip 5000 in a radial direction generally parallel to axis 27 (FIGS. 17 and 23). In some aspects, lock 4300 can completely extend across second end 3600 at upper cavity 3300 to prevent movement of bristle strip 5000 in a radial direction generally parallel to axis 27. Second end 3600 at upper cavity 3300 can be completely covered to retain bristle strip 5000. In other aspects, bristle strip 5000 can be coupled to carrier 3000 by snaps, adhesive, or another attachment method.

In some aspects, lock 4300 can be pivoted away from second end 3600 of carrier 3000 via lock hinge 4400. Accordingly, because lock 4300 is not preventing movement of bristle strip 5000 in a radial outward direction, bristle strip 5000 can be removed from carrier 3000 for servicing or replacement.

An example method of assembly and replacement is shown in FIG. 19. The method will be described particularly with reference to gutter broom 100, however, it will be appreciated that the method can be applied to gutter broom 1000, as well as other gutter brooms contemplated.

For initial assembly, an operator can receive modular components of gutter broom 100, including mandrel 200, carriers 300, and bristle strips 500. Due to their generally flat shape, bristle strips 500 can be efficiently packaged and shipped. Bristle strips 500 can be received according to the operator's needs. For example, the operator can require bristle strips 500 comprising steel wire and/or polypropylene and receive bristle strips 500 accordingly.

To initially assemble gutter broom 100, the operator can slide one or more carriers 300 onto mandrel 200, as shown in step 1910. The operator can repeat this step for each of up to approximately 30 carriers 300. For gutter broom 1000, this step can include pivoting carriers 3000 inward and sliding them onto mandrel 2000. Once carrier detent tabs 2900 are cleared, carriers 3000 can be pivoted outward toward their biased position to engage with carrier detent tabs 2900 and secure onto mandrel 2000. In step 1920, the operator can slide one or more bristle strips 500 into the one or more carriers 300. The operator can repeat this step for as many carriers, such as up to approximately 20 carriers 300 or 3000, that are removably coupled to mandrel 200. Assembly and servicing can additionally be simple, requiring no tools. A full gutter broom 100 can be seen in FIG. 20.

As shown in FIG. 19, in step 1930, the operator can the remove at least one bristle strip 500. This can be to replace or repair bristle strips 500, or to better adapt gutter broom 100 to a particular surface, e.g., to provide a less abrasive contact. To remove bristle strips 500, the operator can push the cantilevered locking member 430 aside and slide out bristle strip 500. Second end 360 of carrier 300 can be open such that bristle strip 500 can be slid out when locking member 430 is pushed aside. Gutter broom 100 with a bristle strip 500 removed can be seen in FIG. 21. For gutter broom 1000, lock 4300 can be pivoted away from second end 3600 of carrier 3000 by unclipping lock end 4800 from lock tab 4900 of carrier 3000 (i.e., releasing lock 4300). Bristle strip 5000 can be slid out once lock 4300 is cleared from second end 3600 of carrier 3000. As discussed above, as gutter broom 100 rotates about central axis 20, each bristle strip 500 can wear more evenly. Because of the distributed wear, bristle strips 500 having the same properties and that are assembled together can require replacement at the same time.

In an aspect, steps 1920 and 1930 can be performed more regularly than steps 1940 and 1910 to maintain and/or repair gutter broom 100. Thus, replacement of bristle strips 500 is considered to be high frequency maintenance, while replacement of carriers 300 is considered to be low frequency maintenance.

In some aspects, bristle strip 500 can be removably coupled to carrier 300 prior to carrier 300 being removably coupled to mandrel 200 and disposed in channel 250 of mandrel 200. Bristle strip 500 can alternatively be removably coupled to carrier 300 once carrier 300 is removably coupled to mandrel 200 and disposed in channel 250. Accordingly, bristle strip 500 can be removed from carrier 300 both before and after carrier 300 is removably coupled to mandrel 200 and disposed in channel 250.

Typically, only bristle strips 500 need to be replaced due to wear, but occasionally carrier 300 might need to be replaced due to damage or wear. As shown in FIG. 19, in step 1940, the operator can remove at least one carrier 300 that receives a bristle strip 500. Carrier 300 cannot be removed while it contains a bristle strip 500. So bristle strip 500 (step 1930) must be removed prior to removing carrier 300 (step 1940). To remove carriers 300, the operator can slide carriers 300 over first outer edges 230 and second outer edges 240, including over carrier detent tabs 290 for approximately a distance D4 (FIG. 7). Gutter broom 100 with a carrier 300 removed can be seen in FIG. 22. In some aspects, carrier 300 can be removed from mandrel 200 while bristle strip 500 is removably coupled to carrier 300. Accordingly, carrier 300 and a bristle strip 500 received in carrier 300 can be removed from mandrel 200 at once.

In an aspect, carrier 300 can contact surfaces and/or debris with less frequency than bristle strip 500. Accordingly, in an aspect, carrier 300 can have a lower replacement frequency than bristle strip 500. In an aspect, mandrel 200 can have a lower replacement frequency than both carrier 300 and bristle strip 500. Mandrel 200 and/or carrier 300 can be replaced if either experiences significant damage or wear. Replacement of mandrel 200, carrier 300, and/or bristle strip 500 can also require no tools.

It is to be appreciated that the Detailed Description section, and not the Summary and Abstract sections, is intended to be used to interpret the claims. The Summary and Abstract sections may set forth one or more but not all exemplary aspects of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific aspects will so fully reveal the general nature of the invention that others can, by applying knowledge within the skill of the art, readily modify and/or adapt for various applications such specific aspects, without undue experimentation, without departing from the general concept of the present invention. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary aspects, but should be defined only in accordance with the following claims and their equivalents.

What is claimed is:

1. A bristle strip for a gutter broom, comprising:

a first bristle comprising a first end and a second end and folded at a center between the first end and the second end;

an insert;

an upper end comprising the center of the first bristle and encased in the insert; and a lower end comprising the first end and the second end of the first bristle, the lower end bending towards the upper end to form an acute angle between the lower end and the upper end.

2. The bristle strip of claim 1, wherein the angle between the upper end and the lower end is between approximately 60 degrees and approximately 80 degrees.

3. The bristle strip of claim 1, wherein the upper end comprises a first cross-sectional area and the lower end comprises a second cross-sectional area smaller than the first cross-sectional area.

4. The bristle strip of claim 1, wherein the first bristle comprises steel.

5. The bristle strip of claim 1, wherein the insert comprises steel.

6. The bristle strip of claim 1, further comprising a second bristle, wherein the first bristle and the second bristle have different lengths.

7. The bristle strip of claim 1, further comprising a second bristle, wherein the first bristle comprises steel and the second bristle comprises polypropylene.

8. The bristle strip of claim 1, further comprising a second bristle, wherein the first bristle comprises a first stiffness and the second bristle comprises a second stiffness different from the first stiffness.

9. A bristle strip for a gutter broom, comprising:

a first wire comprising a first end and a second end and folded at a folding point between the first end and the second end to form bristles; and an insert encasing the first wire at the folding point, wherein the insert is formed at an angle such that a lower end of the bristles comprising the first end and the second end of the first wire bends towards the folding point to form an acute angle between the lower end and the folding point.

10. The bristle strip of claim 9, wherein the angle of the insert is between approximately 60 degrees and approximately 80 degrees.

11. The bristle strip of claim 9, further comprising a second wire folded over the cable to form more bristles, wherein the first wire and the second wire have different lengths.

12. The bristle strip of claim 11, wherein the first wire comprises steel and the second wire comprises polypropylene.

13. The bristle strip of claim 11, wherein the first bristle wire a first stiffness and the second wire comprises a second stiffness different from the first stiffness.

14. The bristle strip of claim 9, wherein the first bristle comprises a recyclable material.

15. A bristle strip for a gutter broom, comprising:

a first bristle comprising a first end and a second end and folded at a center between the first end and the second end, the first end and the second end extending parallel to each other;

a second bristle;

an insert;

an upper end comprising the center of the first bristle and encased in the insert; and a lower end comprising the first end and the second end of the first bristle and oriented obliquely relative to the upper to form an obtuse angle, wherein the first bristle comprises a first stiffness and the second bristle comprises a second stiffness different from the first stiffness.

16. The bristle strip of claim 15, wherein the obtuse angle is between approximately 120 degrees and approximately 150 degrees.

17. The bristle strip of claim 15, wherein the upper end comprises a first cross-sectional area and the lower end comprises a second cross-sectional area smaller than the first cross-sectional area.

18. The bristle strip of claim 15, further comprising a second bristle, wherein the first bristle and the second bristle have different lengths.

19. The bristle strip of claim 15, further comprising a second bristle, wherein the first bristle comprises steel and the second bristle comprises polypropylene.

* * * * *